US007391999B2

(12) United States Patent
Yamada

(10) Patent No.: US 7,391,999 B2
(45) Date of Patent: Jun. 24, 2008

(54) DEVELOPER SUPPLY CONTAINER AND COUPLING MEMBER USED THEREFOR

(75) Inventor: Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 11/275,164

(22) Filed: Dec. 16, 2005

(65) Prior Publication Data

US 2006/0133855 A1 Jun. 22, 2006

(30) Foreign Application Priority Data

Dec. 17, 2004 (JP) ..... 2004-366015

(51) Int. Cl.
*G03G 15/08* (2006.01)

(52) U.S. Cl. ..... 399/262

(58) Field of Classification Search ..... 399/103, 399/105, 106, 167, 258, 262, 263, 107; 222/DIG. 1
See application file for complete search history.

(56) References Cited

U.S. PATENT DOCUMENTS

| | | | | |
|---|---|---|---|---|
| 5,513,679 | A | 5/1996 | Yamada | 141/364 |
| 5,515,143 | A * | 5/1996 | Shiotani | 399/106 |
| 5,842,962 | A | 12/1998 | Yamada et al. | 492/18 |
| 6,314,261 | B1 | 11/2001 | Omata et al. | 399/258 |
| 6,370,349 | B2 * | 4/2002 | Tsuji et al. | 399/262 |
| 6,879,789 | B2 | 4/2005 | Yamada et al. | 399/106 |
| 6,920,298 | B2 | 7/2005 | Yamada et al. | 399/106 |
| 6,934,494 | B2 | 8/2005 | Yamada et al. | 399/262 |
| 6,944,417 | B2 | 9/2005 | Yamada et al. | 399/263 |
| 6,947,690 | B2 | 9/2005 | Tazawa et al. | 399/258 |
| 6,963,713 | B2 | 11/2005 | Isomura et al. | 399/262 |
| 6,980,754 | B2 | 12/2005 | Isomura et al. | 399/106 |
| 6,990,301 | B2 | 1/2006 | Yamada et al. | 399/106 |
| 7,039,347 | B2 | 5/2006 | Yamada et al. | 399/263 |
| 7,079,788 | B2 | 7/2006 | Ban et al. | 399/120 |
| 7,127,193 | B2 | 10/2006 | Yamada et al. | 399/106 |
| 7,209,686 | B2 * | 4/2007 | Yamada | 399/258 |
| 2005/0025529 | A1 | 2/2005 | Isomura et al | 399/262 |
| 2005/0047818 | A1 | 3/2005 | Yamada et al. | 399/106 |
| 2006/0008290 | A1 | 1/2006 | Yamada et al. | 399/106 |
| 2006/0008291 | A1 | 1/2006 | Yamada et al. | 399/106 |
| 2006/0034641 | A1 | 2/2006 | Yamada et al. | 399/258 |

FOREIGN PATENT DOCUMENTS

| | | |
|---|---|---|
| JP | 2002-318490 | 10/2002 |

* cited by examiner

*Primary Examiner*—Hoan H Tran
(74) *Attorney, Agent, or Firm*—Fitzpatrick, Cella, Harper & Scinto

(57) ABSTRACT

A coupling member to be engaged by snap hooking with an engaging hole provided to a driving portion of a main assembly of an image forming apparatus is provided with a snap hook portion at an entire peripheral surface thereof so as to prevent idle running at the time of start of rotation of the driving portion to obviate an impingement shock when the coupling member is caused to impinges on a rib provided to the driving portion.

18 Claims, 14 Drawing Sheets

DEVELOPER SUPPLY CONTAINER AND COUPLING MEMBER USED THEREFOR

FIELD OF THE INVENTION AND RELATED ART

The present invention relates to a developer supply container used in an image forming apparatus such as a copying machine, a printer, a facsimile machine, etc., and a coupling member for use in the developer supply container.

Particulate toner has long been used as the developer for an electrostatic image forming apparatus such as an electrophotographic copying machine, a printer, etc. It has been common practice to use a toner accommodation container (toner supply container) to supply the main assembly of an electrophotographic image forming apparatus with toner, as the toner in the main assembly of an electrophotographic image forming apparatus is depleted of toner by consumption.

Here, an electrophotographic image forming apparatus means an apparatus which forms an image on recording medium with the use of an electrophotographic image forming method. It includes an electrophotographic copying machine, an electrophotographic printer (for example, laser beam printer, LED printer, etc.), a facsimile machine, a word-processor, etc.

Toner is in the form of extremely small particulate. Therefore, toner is likely to scatter when supplying the main assembly of an image forming apparatus with it. Thus, a method in which a toner supply container is placed in the main assembly to prevent toner from scattering, and toner is discharged from the toner supply container little by little through a small opening has been known.

All of the toner supply containers for those apparatuses described above are structured so that they are driven by some means or other from the main assembly side of an image forming apparatus. As they receive driving force from the main assembly side, the convey member or container body on the toner supply container side is driven to discharge toner from them.

An example of such toner supply containers is disclosed in Japanese Laid-open Patent Application (JP-A) 2002-318490. The toner supply container disclosed in JP-A 2002-318490 comprises a cylindrical (bottle-like) main structure or container body, and a toner outlet (opening). The toner outlet is smaller in diameter than the container body, and projects from the container body. It is fitted with a sealing member removably attachable to the toner outlet to seal or unseal the toner outlet. The toner supply container is structured so that as it receives rotational driving force from the main assembly of an image forming apparatus, the container body rotates to discharge toner little by little from the toner outlet to supply the main assembly with toner as necessary.

This toner supply container is characterized in that the rotational driving force from the main assembly of an image forming apparatus is transmitted to the container body through the sealing member attached to one of the lengthwise ends of the toner supply container. In other words, not only is this sealing member given the function of keeping the toner outlet openably sealed, but also, the function of the coupling for receiving the rotational force from the main assembly of an image forming apparatus.

More specifically, as the main front cover of the main assembly of an image forming apparatus is closed after mounting of the toner supply container in the main assembly, the toner supply container is engaged with the driving portion of the main assembly by the closing movement of the main cover. Then, the sealing member is partially separated from the toner outlet, unsealing the toner supply container, and the container body is rotationally driven by the force transmitted through the sealing member. For this reason, a user is not required to directly unseals the sealing member, thus simply performing toner supply operation with less contamination.

Giving all the functions necessary to supply the main assembly of an image forming apparatus with toner, that is, the functions of "coupling", "unsealing", and "driving", to a single component, that is, the sealing member, makes it possible to integrate the mechanism for opening or closing the cap of the toner supply container, with the bottle drive mechanism for rotationally driving the toner supply container, on the main assembly side of the image forming apparatus, not only making it therefore possible to reduce in size the main assembly of the image forming apparatus, but also, improving the image forming apparatus in usability.

The sealing member disclosed in JP-A 2002-318490 is provided with a specific shape and constitution in order to realize these operations. The sealing member is provided with a cylindrical coupling engagement portion, engaged with the driving portion of the main assembly, provided with a snap-fitting portion.

By utilizing the engagement of this snap-fitting portion with the driving portion of the main assembly of an image forming apparatus, the sealing member and the container body of the toner supply container are moved relative to each other to unseal the sealing member. Further, the sealing member located at the unsealed portion receives the rotational force from the main assembly driving portion and transmit it to the container body of the toner supply container.

The snap-fitting portion, utilizing elastic deformation, of a sealing member has not only the function of coupling, but also the function of receiving and transmitting the rotational driving force.

However, in spite of being excellent in structure as described, the above described conventional toner supply container is problematic in that during a period in which the main assembly driving portion is stated to be rotated and then a rib thereof is engaged with the snap-fitting portion, the main assembly driving portion runs idle in some cases.

More specifically, during the engagement of the rib of the driving portion of the main assembly with the snap-fitting portion of a sealing member, there is a possibility of an occurrence of shock due to impingement therebetween.

Accordingly, in the case of decreasing an operation force during the snap-fitting operation by reducing the strength of the snap-fitting portion, due to the occurrence of the shock, there is a possibility of a lowering in durability.

SUMMARY OF THE INVENTION

Thus, an object of the present invention is to provide a developer supply container capable of improving a durability of a coupling member.

Another object of the present invention is to provide a developer supply container capable of alleviating an abutting (contact) shock between the coupling member and a cylindrical member of an image forming apparatus.

According to an aspect of the present invention, there is provided a developer supply container detachably mountable to an image forming apparatus including a hollow cylindrical member having at least one hole and at least one rib formed between circumferential ends of one hole or between adjacent ones of a plurality of holes, comprising:

a container body for containing toner;

a coupling member including hooks for hook engagement with the at least one hole of the cylindrical member by relative motion between the cylindrical member and the coupling member in a direction of overlapping therebetween, and at least one hook of the plurality of hooks receiving a rotational force by abutment of the one rib to discharge the developer out of the container body;

wherein the hooks are provided at an entire circumferential surface of the coupling member so as to establish an engageable relationship between the cylindrical member and the coupling member in a rotation direction of the container body by the relative motion.

According to another aspect of the present invention, there is provided a developer supply container detachably mountable to an image forming apparatus including a hollow cylindrical member having at least one hole and at least one rib formed between circumferential ends of one hole or between adjacent ones of a plurality of holes, comprising:

a container body for containing toner;

a coupling member including hooks for hook engagement with the at least one hole of the cylindrical member by relative motion between the cylindrical member and the coupling member in direction of overlapping therebetween, and at least one hook of the plurality of hooks receiving a rotational force by abutment of the one rib to discharge the developer out of the container body, wherein the hooks are provided at an entire circumferential surface of the coupling member so that the at least one rib is disposed between two hooks in a rotation direction of the container body by the relative rotation.

According to a further aspect of the present invention, there is provided a coupling member of a developer supply container which is detachably mountable to an image forming apparatus including a hollow cylindrical member having at least one hole and at least one rib formed between circumferential ends of one hole or between adjacent ones of a plurality of holes, comprising:

a coupling portion including hooks for hooking engagement with the at least one hole of the cylindrical member by relative motion between the cylindrical member and the coupling portion in a direction of overlapping therebetween, and at least one hook of the plurality of hooks receiving a rotational force by abutment of the one rib to discharge the developer out of the container body, wherein the hooks are provided at an entire circumferential surface of the coupling member so as to establish an engageable relationship between the cylindrical member and the coupling member in a rotation direction of the container body by the relative motion.

According to a still further aspect of the present invention, there is provided a coupling member of a developer supply container which is detachably mountable to an image forming apparatus including a hollow cylindrical member having at least one hole and at least one rib formed between circumferential ends of one hole or between adjacent ones of a plurality of holes, comprising:

a coupling portion including hooks for hooking engagement with the at least one hole of the cylindrical member by relative motion between the cylindrical member and the coupling portion in a direction of overlapping therebetween, and at least one hook of the plurality of hooks receiving a rotational force by abutment of the one rib to discharge the developer out of the container body, wherein the hooks are provided at an entire circumferential surface of the coupling member so that the at least one rib is disposed between two hooks in a rotation direction of the container body by the relative rotation.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferable embodiments of the sealing member and developer supply container in accordance with the present invention will be described in detail with reference to the drawings.

Figure 1:
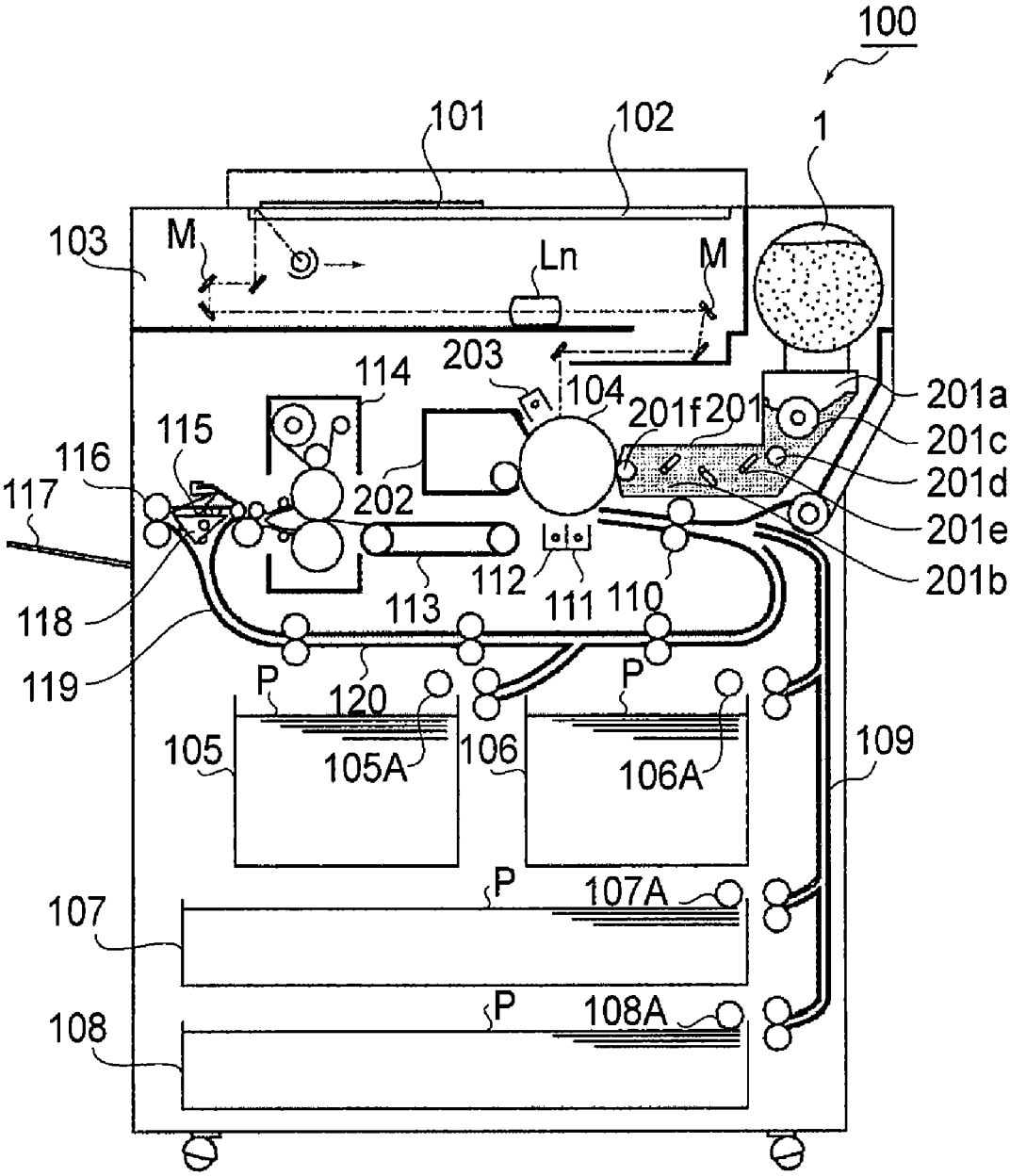
FIG. 1 is a sectional view of an example of an image forming apparatus in accordance with the present invention.

First, referring to FIG. 1, an example of an electrophotographic image forming apparatus in which a toner supply container, as a developer supply container, which is equipped with the sealing member in accordance with the present invention will be described regarding its structure.

[Electrophotographic Image Forming Apparatus]

As an original 101 is placed on the original placement glass platen 102 of the main assembly of the electrophotographic copying machine 100 (which hereinafter will be referred to simply as "apparatus main assembly"), an optical image reflecting the image formation data of the original 101 is formed on the electrophotographic photosensitive drum 104 (which hereinafter will be referred to as "photosensitive drum") as an image bearing member by a plurality of mirrors M and lenses Ln of the optical portion 103 of the main assembly. Designated by referential numbers 105-108 are cassettes, from among which the cassette containing recording mediums (which hereinafter may be referred to simply as "papers (or sheets)") P, which agree in size with the information inputted by an operator through the control panel 100*a*, or are most suitable to the size of the original 101, is selected, based on the information regarding the sizes of the papers in the cassettes 105-108. The recording medium does not need to be limited to paper. For example, an OHP sheet or the like may be used as necessary.

The papers P are conveyed one by one by separating and conveying apparatuses 105A-108A, to a pair of registration rollers 110 by way of a paper conveyance path 109. Then, each paper P is conveyed further by the pair of registration rollers 110 in synchronism with the rotation of the photosensitive drum 104 and the scanning timing of the optical portion 103. In the transfer station, the toner image formed on the photosensitive drum 104 is transferred onto the paper P by a transfer discharging device 111. Then, the paper P on which the toner image has just been transferred is separated from the photosensitive drum 104 by the separation discharge device 112.

Thereafter, the paper P is further conveyed by a paper conveying portion 113 to the fixation station 114, in which the toner image on the paper P is fixed by heat and pressure. Then, when the copying machine is in the single-sided print mode, the paper P is moved through the reversing station 115, without being placed upside down, and is discharged into the delivery tray 117 by a pair of discharge rollers 116. When the machine is in the two-sided print mode, the flapper 118 of the reversing station 115 is controlled so that the paper P is conveyed to the pair of registration rollers 110 by way of re-feeding conveyance paths 119 and 120. Then, the paper P is made to move through the same paths as those through which the paper P is moved when the machine is in the single-sided print mode, and is discharged into the delivery tray 117.

When the machine is in the multilayer print mode, the paper P is sent through the reversing station 115 so that it is stopped after it is partially extended outward from the main assembly by the pair of discharge rollers 116. More specifically, it is stopped immediately after the trailing edge of the paper P is moved past the flapper 118, while the paper P is remaining pinched by the pair of discharge roller 116. Then, the flapper 118 is switched in position, and the pair of discharge rollers 116 are rotated in reverse so that the paper P is conveyed back into the main assembly. Thereafter, the paper P is conveyed to the registration rollers 110 through paper re-conveyance paths 119 and 120. Then, it is moved through the same paths as those through which it is moved when the machine is in the single-side print mode, and discharged into the delivery tray 117.

In the main assembly 100 of the copying machine structured as described above, the developing apparatus 201, cleaning apparatus 202, primary charging device 203, etc., are disposed in the adjacencies of the peripheral surface of the drum 104.

The developing apparatus 201 is an apparatus for developing, with the use of developer, the electrostatic latent image formed on the peripheral surface of the drum 104 by exposing the uniformly charged peripheral surface of the photosensitive drum 10 by the optical station 103, based on the image formation data extracted from the original 101. The toner supply container 1 for supplying this developing apparatus 201 with toner as developer is to be removably mounted in the main assembly 100 of the copying machine by a user. Incidentally, not only is the present invention is compatible with a toner supply container for supplying the main apparatus of an image forming apparatus with developer consisting of toner, but also, with a toner supply container for supplying the apparatus main assembly with developer comprising a mixture of toner and carrier. This embodiment, however, will be described with reference to the former container.

The developing apparatus 210 comprises a toner hopper 201*a* as a toner storing means, and a developing device 201*b*. The toner hopper 201*a* is provided with a stirring member 201*c* for stirring the toner supplied from the toner supply container 1. After being stirred by the stirring member 201*c*, the toner supplied from the toner supply container 1 is sent to the developing device 201*b* by a magnetic roller 201*d*. The developing device 201*b* comprises a development roller 201*f* and a toner forwarding member 201*e*. After being sent from the toner hopper 201*a* by the magnetic roller 201*d*, the toner is sent to the development roller 201*f* by the toner forwarding member 201*e*, and then, is supplied to the photosensitive drum 104 by the development roller 201*f*.

The cleaning apparatus 202 is for removing the toner remaining on the peripheral surface of the photosensitive drum 104. The primary charger 203 is for charging the photosensitive drum 104.

Figure 2:
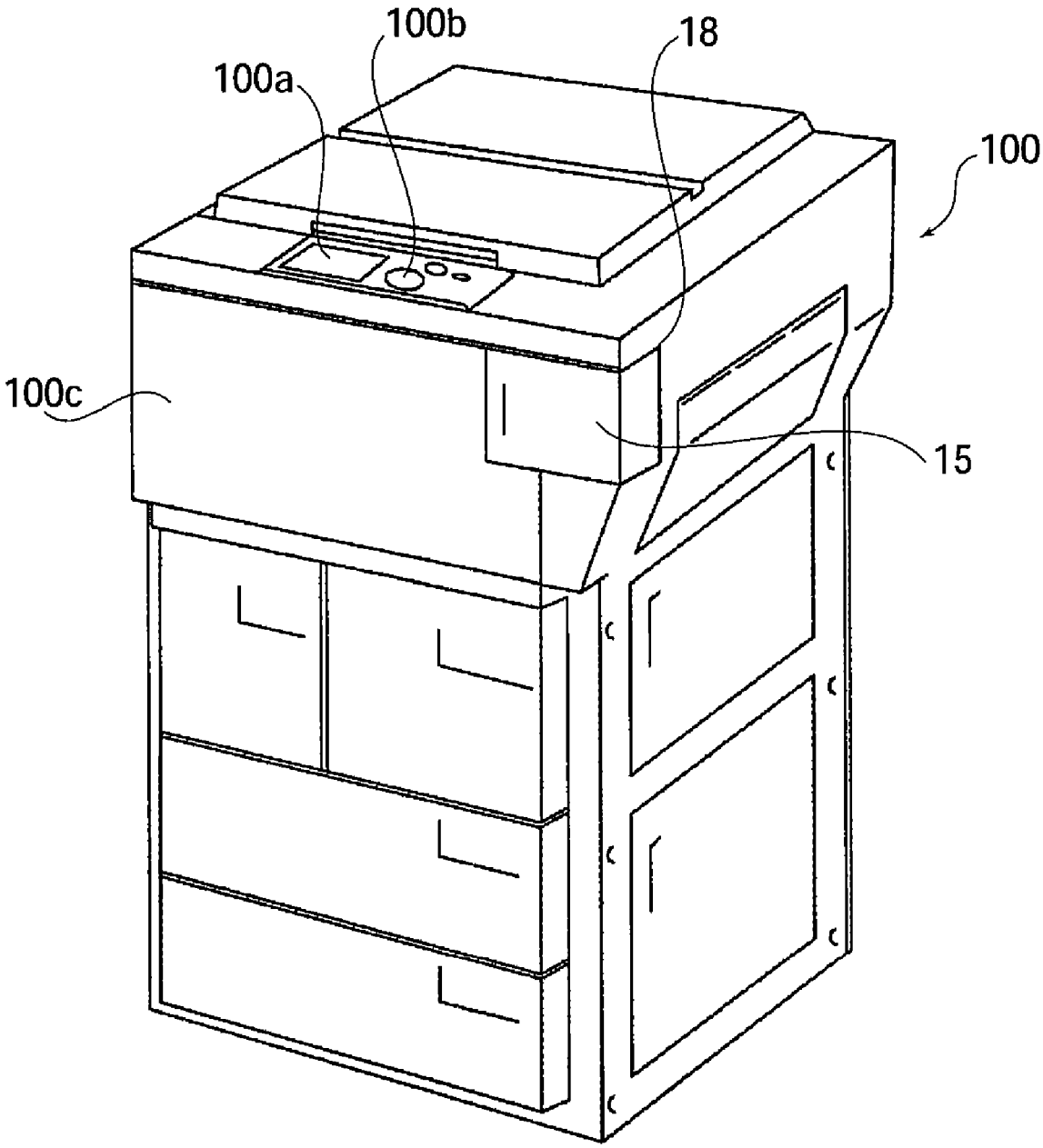
FIG. 2 is a perspective view of the image forming apparatus shown in FIG. 1.
Figure 3:
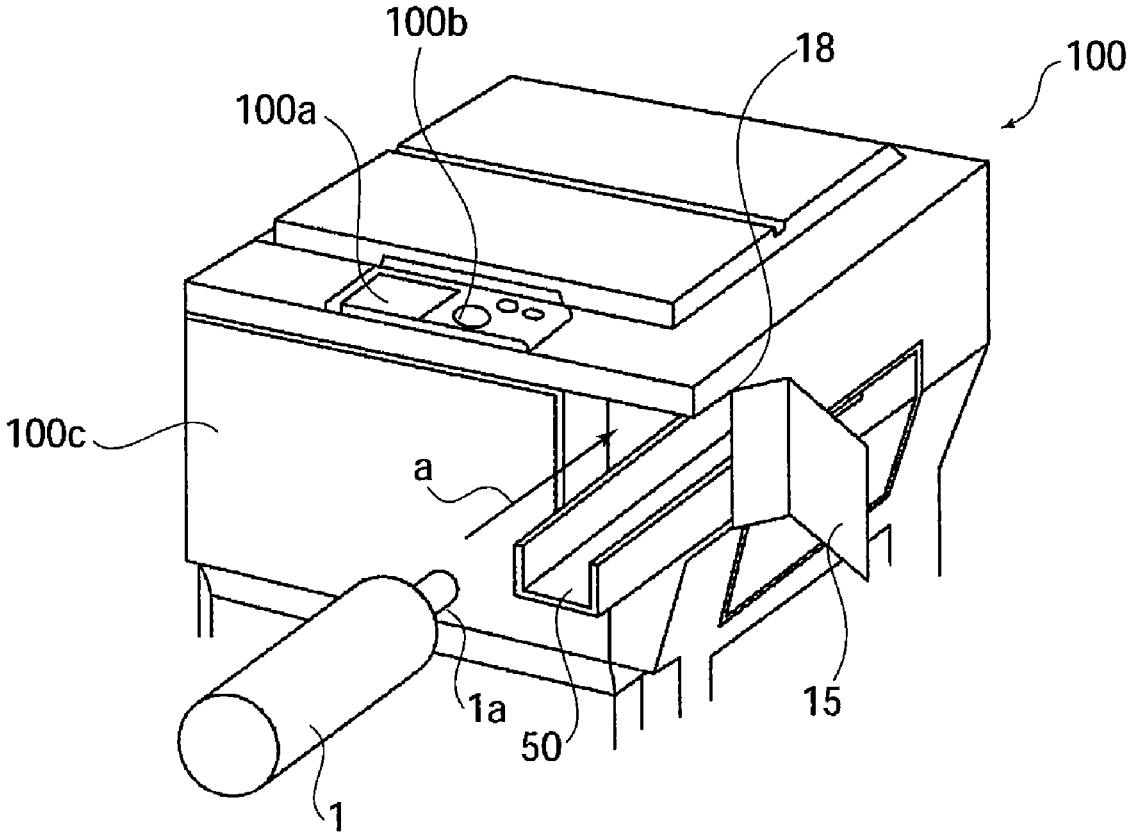
FIG. 3 is a perspective view of the top portion of the image forming apparatus shown in FIG. 1, showing the procedure for mounting a toner supply container into the image forming apparatus.

Referring to FIGS. 2 and 3, as the front cover 15 for the replacement of a toner supply container (which hereinafter will be referred to as "exchange cover"), which constitutes a part of the external shell of the main assembly 100, is opened as shown in FIG. 3, a toner supply container tray 50, which is a part of the toner supply container mounting means, is pulled out by a driving system (unshown) to a predetermined location. The user is to place the toner supply container 1 on the container tray 50. When necessary to remove the toner supply container 1 from the apparatus main assembly 100, the user is to pull out the container tray 50, and remove the toner supply container 1 from the container tray 50. The toner replenishment front cover is a cover dedicated to the operation for mounting or dismounting (exchanging) the toner supply container 1; it is opened or closed only for mounting or dismounting the toner supply container 1. For the maintenance of the apparatus main assembly, the front cover 100*c* is to be opened.

The apparatus main assembly 100 may be structured without the container tray 50 so that the toner supply container 1 can be directly mounting into, or removed from, the apparatus main assembly 100.

[Process of Supplying Apparatus Main Assembly with Toner]

Figure 4:
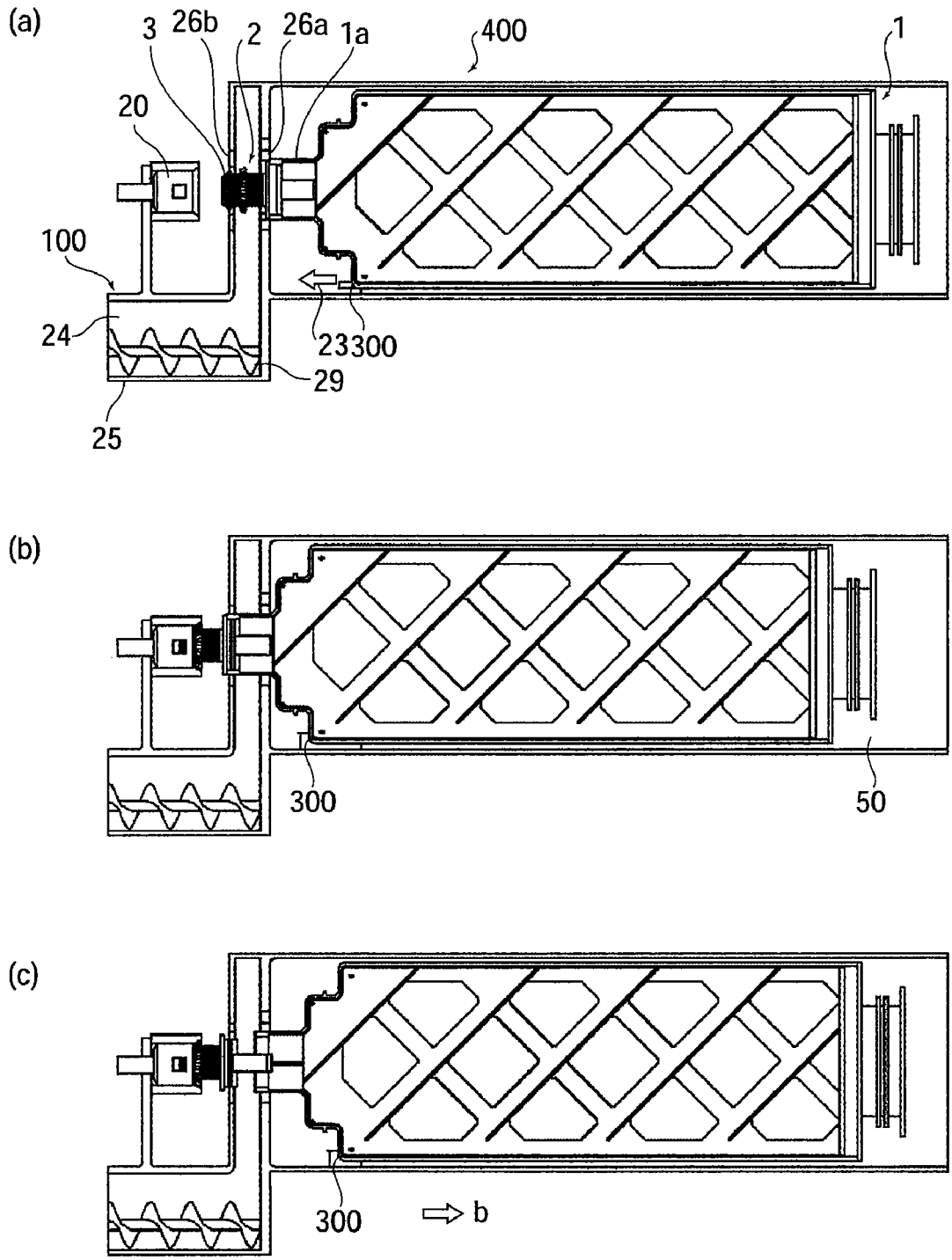
FIGS. 4(*a*), 4(*b*), and 4(*c*) are sectional views of the toner supply container, showing the working of the container at the beginning of the mounting of the toner supply container, during the mounting, and at the completion of the mounting, respectively.

First, referring to FIGS. 4(*a*)-4(*c*), the process of supplying the apparatus main assembly 100 with toner with the use of the toner supply container 1 (which hereinafter may be referred to as "toner bottle") as the developer supply container of the present invention will be described. FIGS. 4(*a*)-4(*c*) show distinctive stages of the process in which the toner bottle 1 is inserted into the apparatus main assembly 100 and the apparatus main assembly 100 is supplied with the toner from the toner bottle 1.

As shown in FIG. 4, the apparatus main assembly 100 is provided with a toner supplying apparatus 400, and the toner supplying apparatus 400 is provided with a driving portion 20 as a hollow cylindrical member which engages with the toner bottle 1 to rotationally drive the toner bottle 1. The driving portion 20 is rotatably supported by an unshown bearing, and is structured so that it is rotationally driven by an unshown motor disposed in the apparatus main assembly 100.

The apparatus main assembly 100 is provided with a partition wall 25, which constitutes a part of the toner supply passage 24 leading to the toner hopper 201*a*, and to which inward and outward bearings 26*a* and 26*b*, which also seal the toner supply passage 24, are firmly attached. The apparatus main assembly 100 is also provided with a screw 27, which is disposed in the toner supply passage 24 to convey the supplied toner to the hopper 201*a*.

FIG. 4(*a*) shows the initial stage of the insertion of the toner bottle 1 into the apparatus main assembly 100. The toner bottle 1 is provided with a cylindrical toner supply outlet 1*a* as a toner discharge opening (which hereinafter may be referred to simply as "outlet" or opening), which is located at one of the lengthwise ends of the toner bottle 1. In the stage shown in FIG. 4(*a*), the opening of the outlet is sealed with a sealing member 2 as a coupling member.

As the toner bottle 1 is further inserted, the snap-fitting portion as a coupling portion, that is, the end portion, of the sealing member 2 enters the driving portion 20 of the apparatus main assembly 100. As a result, an engaging portion 3 of the end portion of the snap-fitting portion snaps into the engaging hole of the driving portion 20, preventing thereby the sealing member from disengaging from the driving portion 20. FIG. 4(*b*) shows this state.

The engagement between the driving portion 20 and the sealing member 2 is performed in the following manner. As a user inserts the toner bottle 1, the driving portion 20 comes into contact with the top surface (pressure receiving portion) of the latching portion 3, and then, as the user inserts the toner bottle 1 deeper, the engaging portion 3 is displaced radially inwardly toward axial line of sealing member by the driving portion 20. Then, as the toner bottle 1 is inserted even deeper by the user, the engaging portion 3 is relieved of the inward displacement from the driving portion 20, allowing the snap-fitting portion (portion which supports the engaging portion 3) to recover by its own resiliency, moving thereby the engaging portion 3 back into the original position in terms of the radius direction of the sealing member. As a result the sealing member becomes securely engaged with the driving portion. In other words, in this embodiment, the so-called "snap-fitting system" is employed.

After the engagement between the sealing member 2 and driving portion 20, an engaging surface (second driving force-receiving portion) 3*b*, as the surface by which the engaging portion 3 engages with the driving portion, which is perpendicular to the thrust direction (perpendicular to axial line of sealing member), remains in contact with the internal surface of the engaging hole, as a portion to be engaged, of the driving portion 20. Therefore, the sealing member 2 remains locked (presence of slight play is permissible) with the driving portion 20 unless this engagement between the surface 3*b* and the internal surface of the latching projection catching hole is dissolved.

After the completion of the engagement of the sealing member 2 with the driving portion 20, the toner bottle exchange front cover 15 is closed. As the cover 15 is closed, the sliding member 300 is retracted in the direction indicated by an arrow mark b by the movement of the cover 15, causing the toner bottle 1 to move backward. However, the sealing member 2 is engaged with the apparatus main assembly 100. Therefore, the sealing member 2 is moved in the direction to be separated from the toner bottle 1 in relative terms. As a result, the outlet 1*a* is unsealed, making it thereby possible for the toner in the toner bottle 1 to be supplied to the apparatus main assembly 100, as shown in FIG. 4(*c*).

Then, an unshown motor in the apparatus main assembly 100 is started. As the motor is started, the rotational driving force from the motor is transmitted to the driving force receiving surface 3*a*, as a first driving force receiving portion, of the engaging portion 3 of the sealing member 2 through the driving portion 20 of the apparatus main assembly 100, and is transmitted further to the toner bottle 1 from the sealing member 2. As a result, the toner bottle 1 is rotated, conveying thereby the toner therein and discharging it. In other words, the sealing member 2 has the function of unsealing (or resealing) the toner outlet 1*a*, and also, the function of transmitting the rotational driving force from the main assembly side of the image forming apparatus to the toner bottle side.

The toner bottle 1 is rotatably supported by the bottle supporting rollers 23 of the toner bottle tray 50. Therefore, it can be smoothly rotated by a very small amount of torque. There are four bottle supporting rollers 23, which are optimally distributed for the bottle body 1A of the toner bottle 1 to saddle. The bottle supporting rollers 23 are rotatably attached to the toner supplying apparatus 400 of the apparatus main assembly 100. As the toner bottle 1 is rotated as described above, the toner in the toner bottle 1 is gradually discharged through the outlet 1*a* into the toner supply passage 24, and is conveyed to the hopper 201*a* of the apparatus main assembly 100 by the screw 27 located in the toner supply passage 24; in other words, the apparatus main assembly 100 is supplied with toner.

[Method for Exchanging Toner Supply Container]

Next, the method for exchanging the toner bottle in accordance with the present invention will be described.

As virtually the entirety of the toner in the toner bottle 1 is consumed by image formation, it is detected by a detecting means (unshown) of the apparatus main assembly 100 for detecting whether or not the toner bottle 1 is empty, that the toner bottle 1 is depleted of toner, a user is given this information through a displaying means 100*b* (FIG. 2) such as an LCD.

The toner bottle 1 in this embodiment is to be exchanged by a user himself. The procedure for exchanging the toner bottle 1 is as follows:

First, a user is to rotate the closed toner bottle exchange front cover 15 about the hinge 18 to open it as shown in FIG. 2. As the toner bottle exchange front cover 15 is opened, the bottle body 1A, which is in the state shown in FIG. 4(*c*), is moved in the direction indicated by the arrow mark a in FIG.

Figure 5:
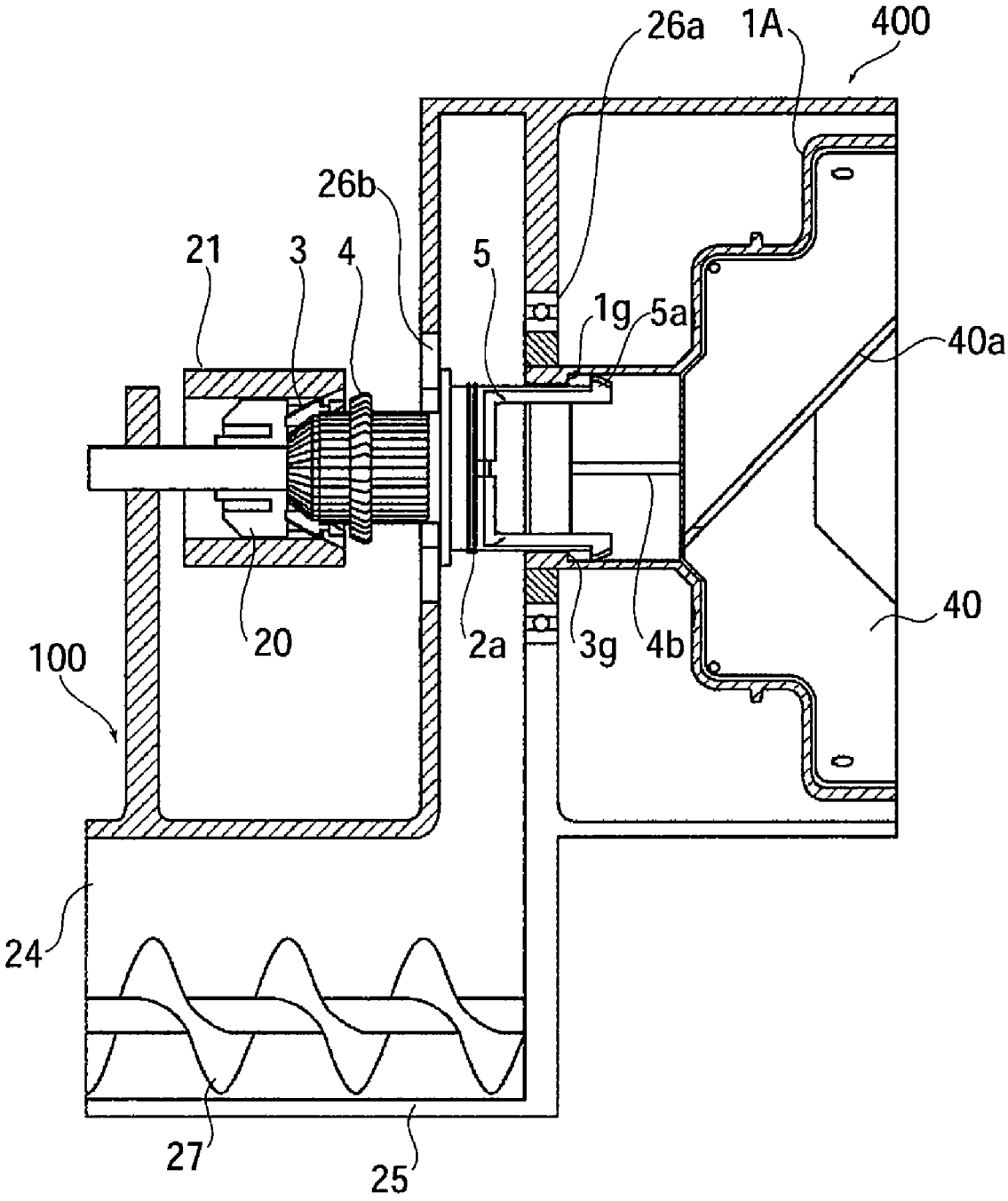
FIG. 5 is an enlarged view of the snap-fitting portions of the sealing member and main assembly of the image forming apparatus from FIG. 4.

4(*a*), which is opposite to the direction indicated by the arrow mark b in FIG. 4(*c*), by an unshown toner supplying portion moving (opening or closing) means, which is moved by the movement of the toner bottle exchange front cover 15. As a result, the sealing member 2, which has remained partially separated from the bottle body 1A, having therefore left the toner outlet 1*a* open, is pressed into the toner outlet 1*a*, resealing thereby the toner outlet 1*a*, as shown in FIG. 4(*b*). In this state, the sealing member 2 still remains locked with the main assembly 100. Then, as pressure is applied to the disengaging portion 4 by the releasing member 21 (FIG. 5), which will be described later, the engaging portion 3 is pressed down together with the disengaging portion 4, freeing thereby the sealing member 2 from the driving portion 20, making it possible for the bottle body 1A to be moved backward. Then, as the toner bottle 1 is pulled backward, the procedure for disengaging the sealing member 2 from the apparatus main assembly 100 is completed.

Next, the user is to pull out the empty toner bottle 1 disengaged from the apparatus main assembly 100, in the opposite direction from the direction indicated by the arrow mark a in FIG. 4(*a*), that is, the direction indicated by the arrow mark b in FIG. 4(*c*), from the apparatus main assembly 100. Next, the user is to insert a new toner bottle 1 into the apparatus main assembly 100 in the direction indicated by the arrow mark a in FIG. 4(*a*), and to close the toner bottle exchange front cover 15. As the toner bottle exchange front cover 15 is closed, the sealing member 2 of the new toner bottle, which has just been engaged with the apparatus main assembly 100, is partially separated from the bottle body 1A, unsealing thereby toner outlet 1*a* (FIG. 4(*c*)). The above is the procedure for exchanging the toner supply container 1.

[Toner Bottle]

Figure 6:
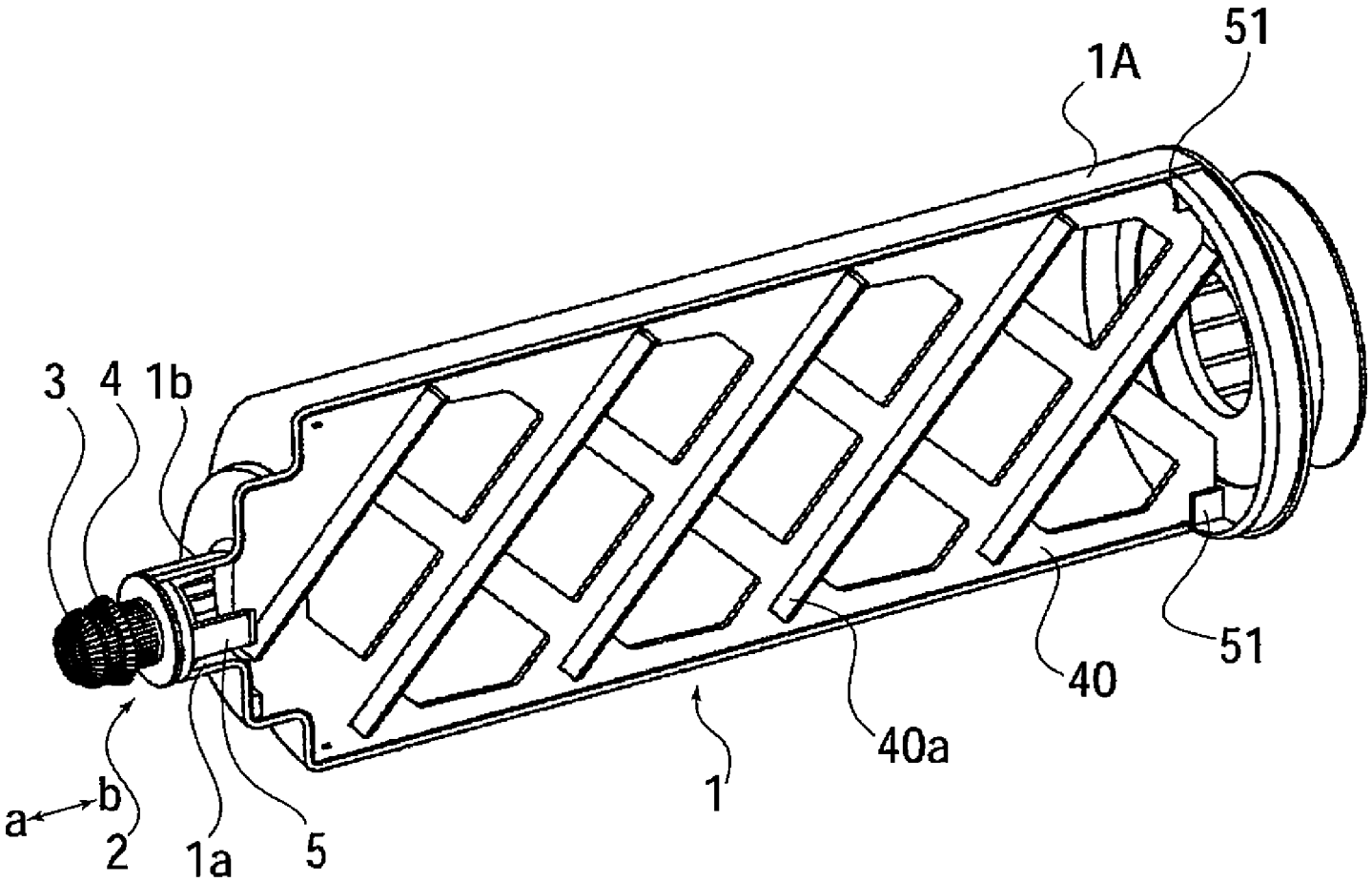
FIG. 6 is a partially broken perspective view of the toner supply container in accordance with the present invention.

Next, referring to FIGS. 6 and 7, the developer supply container 1 in this embodiment will be described. The developer supply container 1 is roughly cylindrical. It has the toner outlet (discharge opening) 1*a*, as a toner discharging port, which is attached to the approximate center of the one of the end surfaces of the container body (bottle body). The toner outlet 1*a* is smaller in diameter than the cylindrical bottle body 1A. The outlet 1*a* is fitted with the sealing member 2, which seals or unseals the outlet 1*a*. As will have been understood through the description given above with reference to FIGS. 4(*a*)-4(*c*), the outlet 1*a* and sealing member 2 are structured so that as the sealing member 2 is slid relative to the outlet 1*a* in the lengthwise direction (direction indicated by arrow mark a or b) of the developer supply container 1, the outlet 1*a* is automatically sealed or unsealed.

The opposite end portion of the sealing member 2, as the coupling member to be coupled with the driving portion 20 of the main assembly, from the container body 1A is cylindrical, and is provided with the engaging portion 3 being engageable with the engaging hole of the driving portion 20 and the disengaging portion 4 for disengaging the engaging portion 3 from the driving portion 20 of the apparatus main assembly 100. This cylindrical end portion, which supports the these engaging portion 3 and disengaging portion 4, is structured so that it is allowed to elastically deform (it is provided with slits which extend from its tip to base portion, in order to make it easier for its projection supporting portions to elastically deform; this will be described later). Each of these engaging portions 3 is structured so that it is engaged with the driving portion 20 of the apparatus main assembly 100 to transmit to the developer supply container 1 the driving force from the apparatus main assembly 100. The structure of the engaging portion 3 of the sealing member 2 will be described later in detail.

First, referring to FIG. 6, the internal structure of the developer supply container 1 will be described. As described above, the developer supply container 1 has a roughly cylindrical shape. It is roughly horizontally placed in the apparatus main assembly 100, and is structured so that as it receives driving force from the apparatus main assembly 100, it rotates.

There is a plate-like baffling member 40 as a toner conveying member in the bottle body 1A of the toner bottle 1. The baffling member 40 is provided with a plurality of ribs, which are attached to both surfaces of the baffling member 40, being angled relative to the direction of the rotational axis of the developer supply container 1. One of the slanted ribs 40*a*, which is closest to the toner outlet 1*a*, is in contact with the toner outlet 1*a* by one end.

The developer supply container 1 is structured so that the toner therein is conveyed by the baffling member 40 toward the outlet 1*a*, and finally, is discharged from the developer supply container 1 through the outlet 1*a* by being assisted by the slanted rib 40*a* closest to the outlet 1*a*.

As for the principle of toner discharge, as the developer supply container 1 is rotated by the rotational force, the toner in the developer supply container 1 is scooped upward by the baffling member 40, and then, slides down on the surfaces of the baffling member 40 while being guided toward the toner outlet 1*a* of the slanted ribs 40*a*. Since the developer supply container 1 is continuously rotated, the above described process of being scooped up and sliding down is repeated by the toner. As a result, the toner is gradually conveyed toward the outlet 1*a* while being stirred, and then, is discharged through the outlet 1*a*. The baffling member 40 in the form of a plate is formed independently from the container body 1A of the developer supply container 1, and is anchored to the container body 1A by the anchoring ribs 51 so that it will rotate with the container body 1A.

The constitution of the container body of the developer supply container 1 is not limited to the above described one in terms of internal shape and constitution, as long as the toner in the developer supply container 1 is discharged from the developer supply container 1 as the developer supply container 1 receives driving force from the main assembly of an image forming apparatus.

Further, in addition to the above described structural arrangement, the container body of the developer supply container 1 may be constituted so that the rotational driving force which the sealing member 2 receives from the apparatus main assembly 100 is transmitted to the rotatable screw, or the like, for conveying toner in such a state that the container body of the developer supply container is fixed in the image forming apparatus. In other words, as far as the internal structure of the developer supply container 1 is concerned, the toner conveying portion may be in the form of the above described baffling member, or a member different in structure from the above described baffling member.

Figure 7:
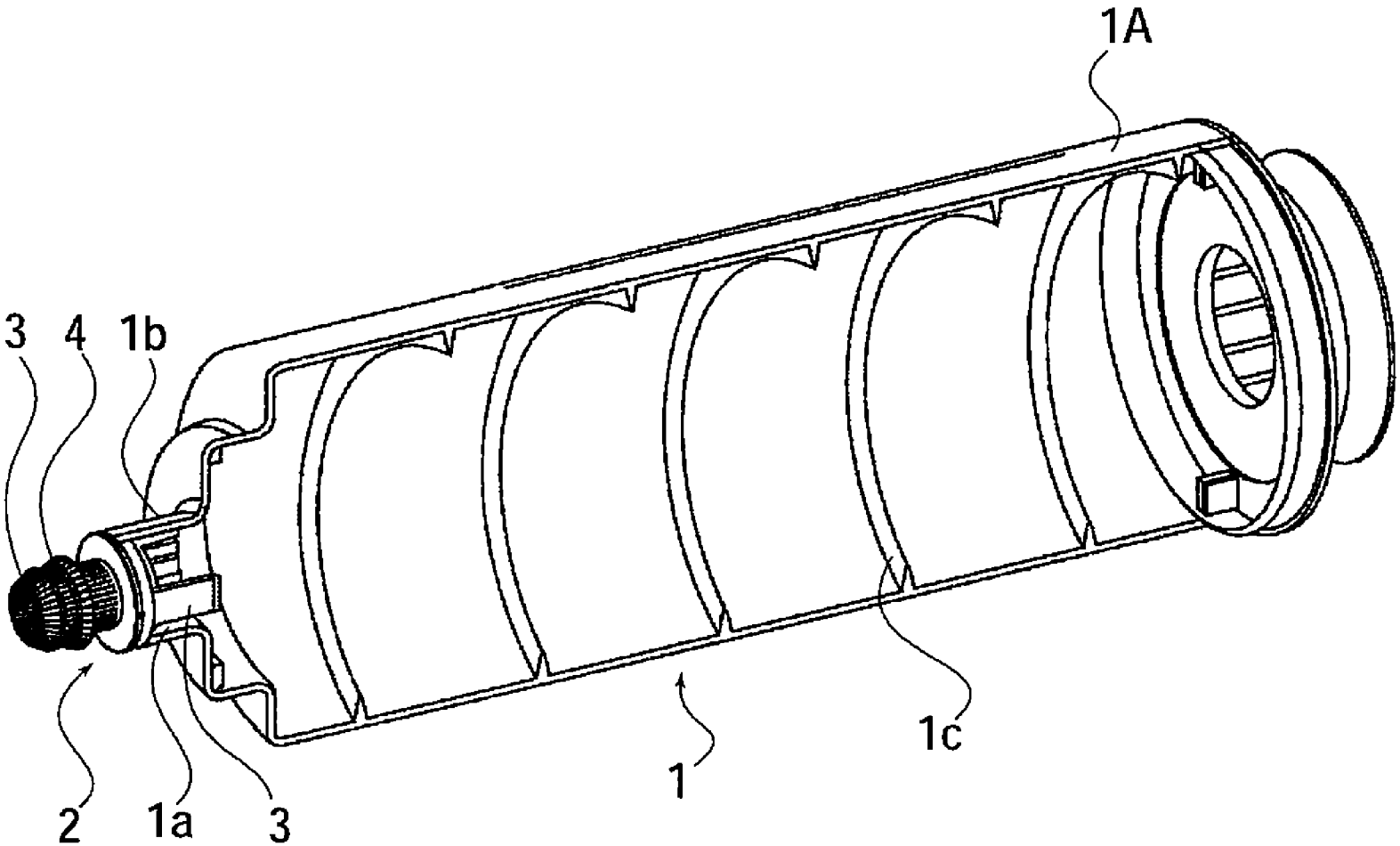
FIG. 7 is a partially broken perspective view of one of the modified versions of the toner supply container in accordance with the present invention.

For example, the internal structure of the bottle body 1A of the toner bottle 1 may be as shown in FIG. 7, which shows one of the modified versions of this embodiment. In this modified version, the toner bottle 1 is in the form of generally known spiral bottle. The toner bottle 1 is provided with a spiral projection 1*c*, which is attached to the internal surface of the cylindrical bottle body 1A. Thus, as the toner supply container 1 rotates, the toner is conveyed by the spiral rib 1*c* in the direction parallel with the axial line of the container body 1A, and then, is discharged from the toner supply container 1 through the outlet 1*a* attached to one of the end surfaces of the container body 1A.

Next, referring to FIG. 8, the bottle body 1A of the toner bottle 1 will be described. The bottle body 1A is provided with the toner outlet 1*a*, which is attached to one of the lengthwise ends thereof. There is a driving force receiving portion 1*b* in the toner outlet 1*a*. The driving force receiving portion 1*b* is an integral part of the bottle body 1A. The driving force receiving portion 1*b* receives the driving force from the driving force transmitting portion 5 of the sealing member 2, and rotates the bottle body 1A. The toner outlet 1*a* of the toner bottle 1 in this embodiment is provided with a pair of driving force receiving portions 1*b*, which are disposed in a manner to oppose each other. However, the position, number, shape, measurements (height, length, etc.) of the driving force receiving portion 1*b* is optional; they are not specifically limited.

Figure 8:
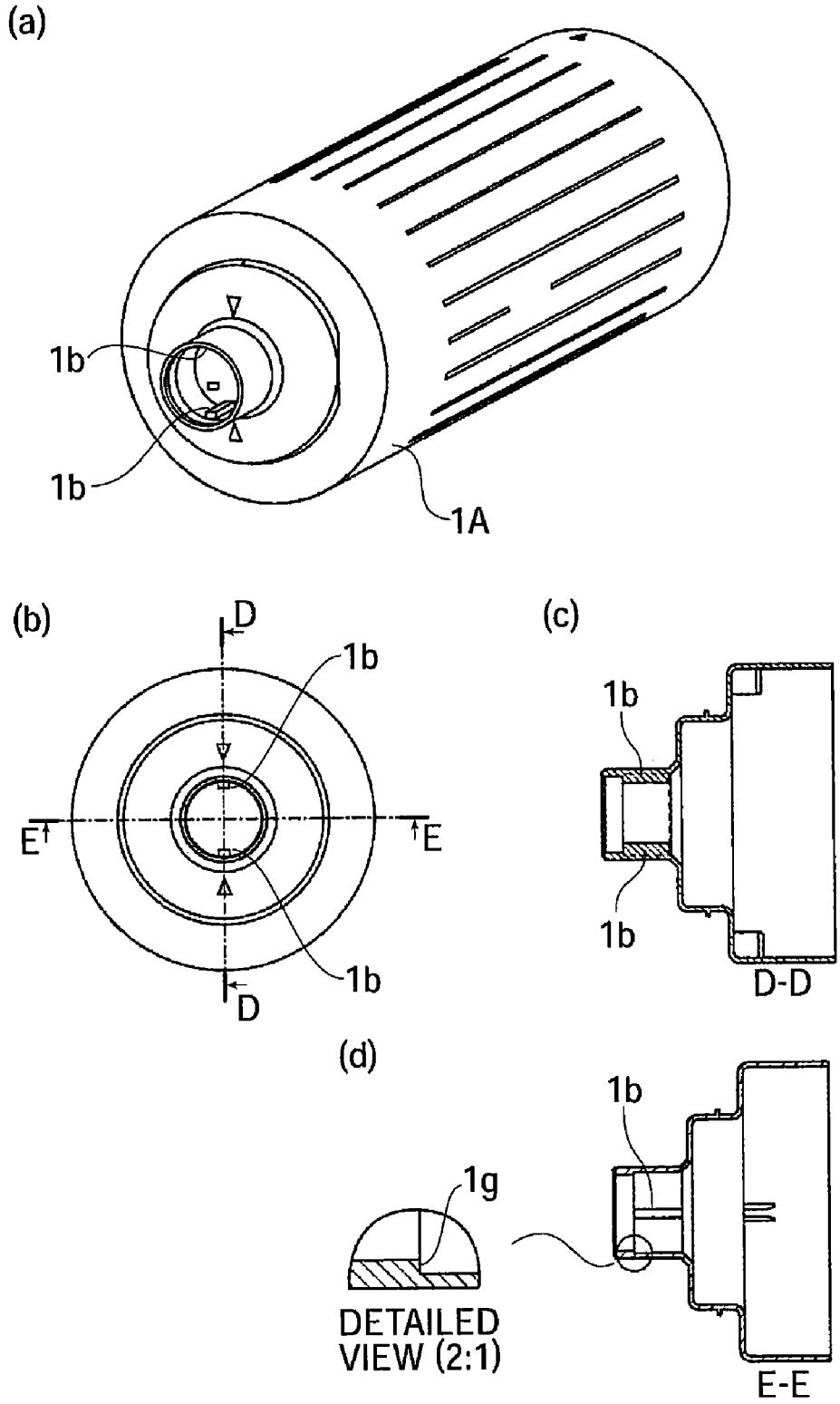
FIGS. 8(*a*), 8(*b*), 8(*c*), and 8(*d*) are a perspective view, a front view, sectional view at the line D-D in 8(*b*), and a sectional view at the line E-E in 8(*b*), of the container body of the toner supply container in accordance with the present invention.

As depicted in detail in FIG. 8, the toner outlet 1*a* has two portions different in wall thickness, having therefore a surface 1*g* comparable to the riser portion of a stair step. This surface 1*g* comes into contact with the surface 5*b* of the driving force transmitting portion 5 to regulate the amount by which the sealing member 2 is allowed to slide outward. The driving force transmitting portion 5 will be described later.

[Sealing Member]

Next, referring to FIGS. 9-11, the structure of the sealing member (driving force-receiving member) 2 as the coupling member will be described further.

Figure 9:
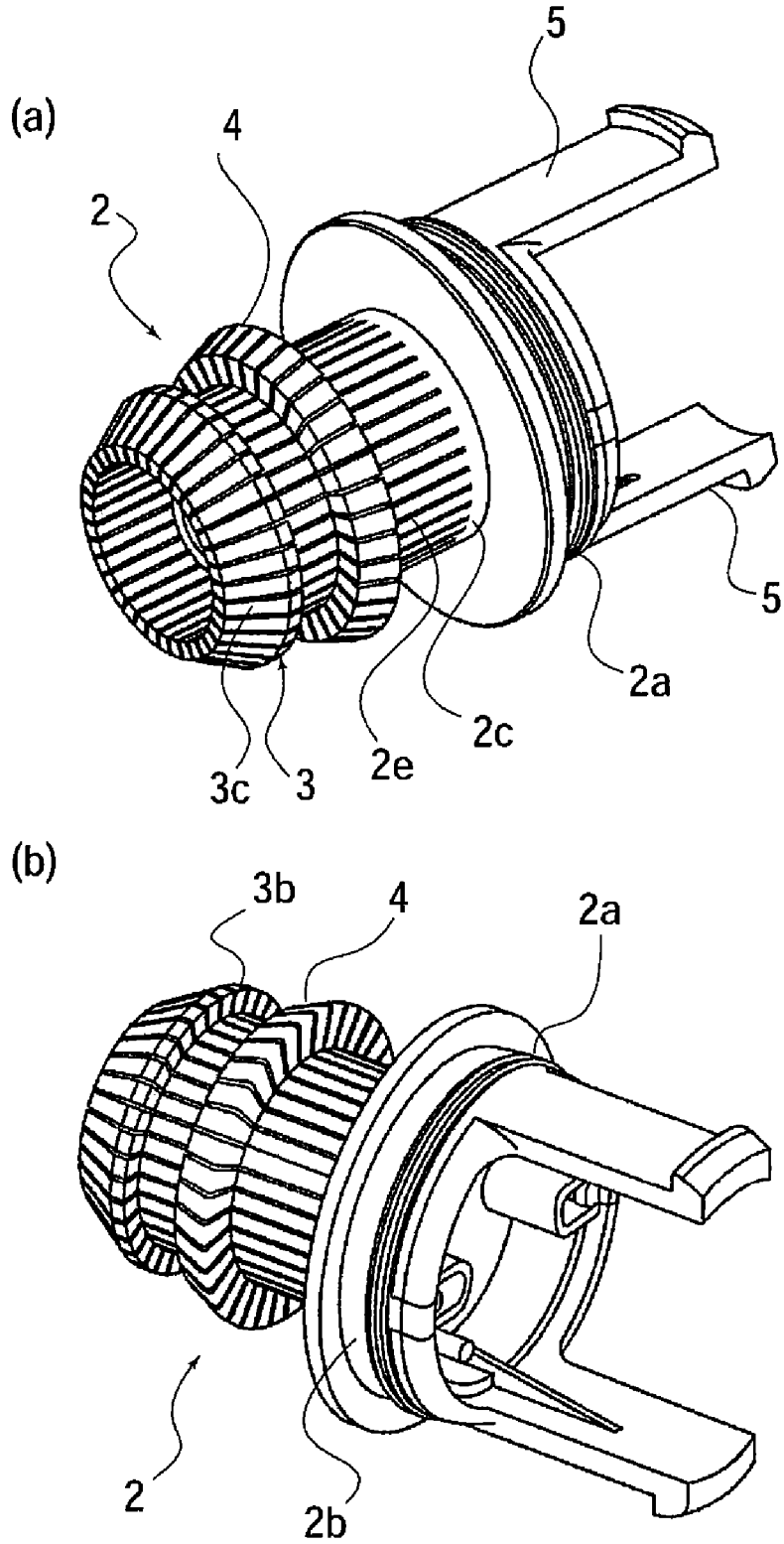
FIGS. 9(*a*) and 9(*b*) are perspective views of the sealing member in accordance with the present invention, as seen from the right and left sides thereof.

FIGS. 9(*a*) and 9(*b*) are perspective views of the sealing member 2 in this embodiment, as seen from the right and left sides thereof, respectively. FIGS. 10(*a*), 10(*b*), 10(*c*), and 10(*d*) are a front view, a left side view, a right side view, and a top view, of the sealing member in this embodiment.

Figure 11:
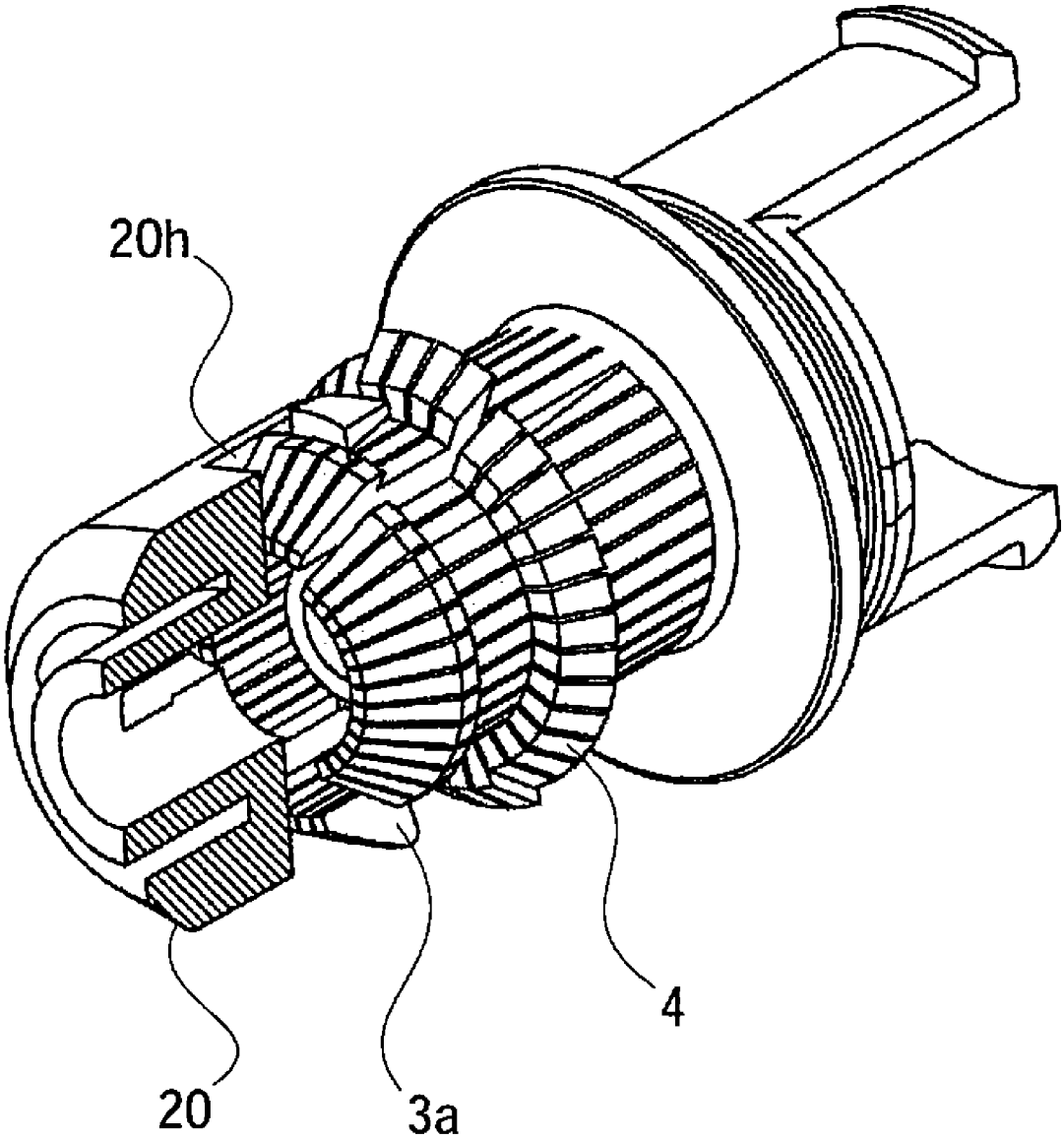
FIG. 11 is a partially broken perspective view of the sealing member of the toner supply container, driving force transmitting portion of the main assembly of the image forming apparatus, and their adjacencies, showing the state of engagement between the sealing member and driving portion.

FIG. 11 is a partially broken perspective view of the toner outlet portion of the toner supply container, and the driving force transmitting portion 20, in this embodiment, while the toner is supplied from the toner supply container to the apparatus main assembly 100 after the coupling of the toner supply container 1 and the driving portion 20.

Figure 10:
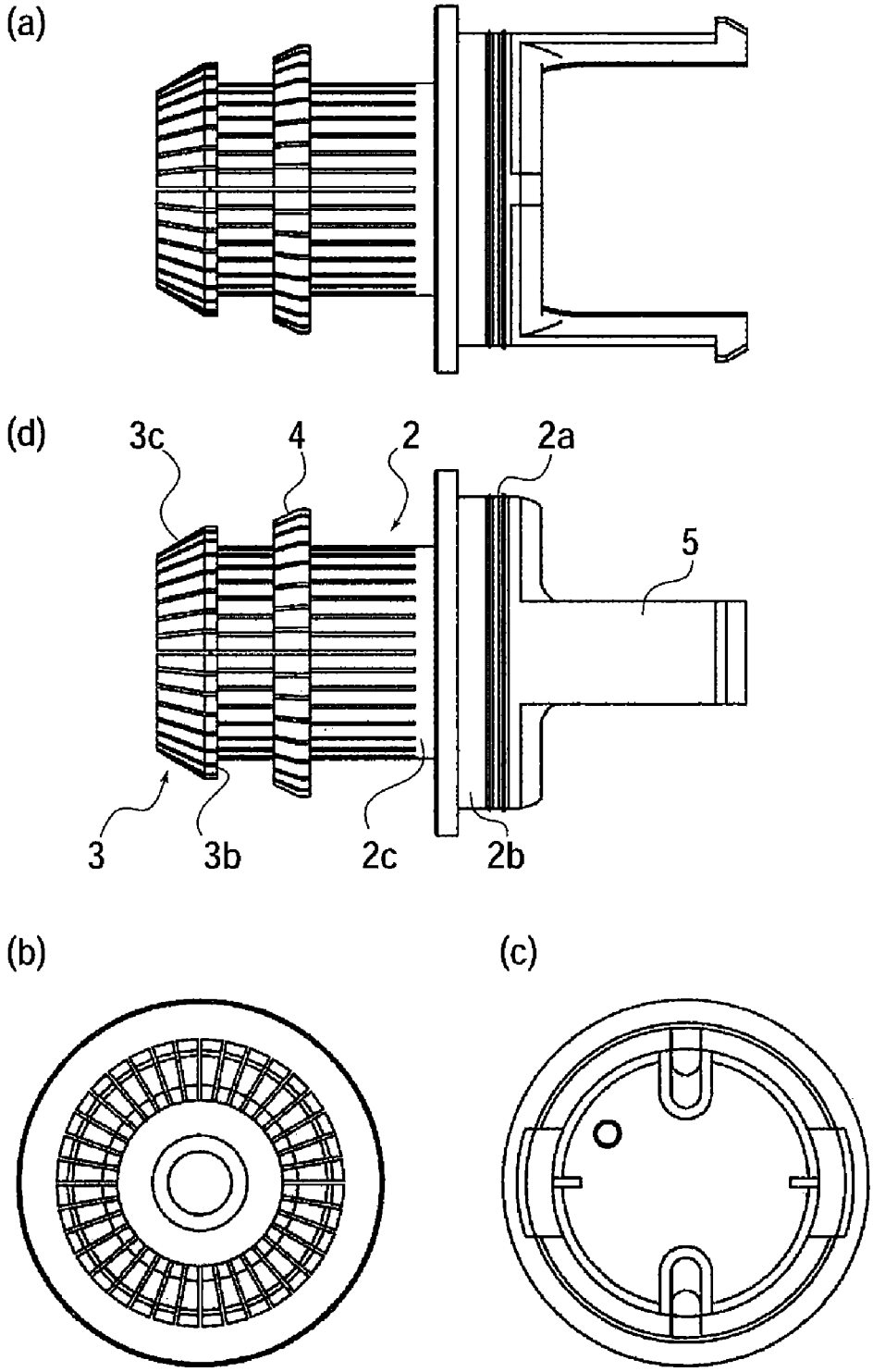
FIGS. 10(*a*), 10(*b*), 10(*c*) and 10(*d*) are a front view, a left side view, a right side view, and a top view, of the sealing member of the toner supply container in accordance with the present invention.

Referring to FIGS. 9 and 10, the sealing member 2 is provided with a sealing portion 2*b* for sealing or unsealing the toner outlet 1*a* of the developer supply container 1, and a cylindrical coupling portion 2*c* which couples with the driving portion 20 of the apparatus main assembly 100. The sealing portion 2*b*, or the cylindrical portion with a larger diameter, is externally fitted with a pair of seals 2*a*, the diameters of which are larger by an appropriate amount than that of the internal diameter of the toner outlet 1*a*. The seals 2*a* are for sealing the gap between the peripheral surface of the sealing portion 2*b* of the sealing member 2, and the internal surface of the toner outlet 1*a*. Therefore, the seals 2*a* are desired to have a proper amount of elasticity. Thus, in this embodiment, the seals 2*a* are integrally formed with sealing member 2, of an elastomer, which is different from the material for the main body of the sealing member 2, by two color injection molding.

As the sealing portion 2*b* is pressed into the toner outlet 1*a*, the outlet 1*a* as the toner discharging port, is sealed with the sealing member 2.

The sealing member 2 performs a plurality of functions for the toner supply container 1. The primary functions of the sealing member 2 are: (1) to unseal the toner outlet 1*a* by engaging with the apparatus main assembly 100; (2) to receive rotational force from the apparatus main assembly 100; (3) to transmit the received driving force to the bottle body 1A of the toner bottle 1; (4) to disengage the toner supply container 1 from the apparatus main assembly 100; and (5) to reseal the toner supply container 1.

As described above, the sealing member 2 performs a plurality of important functions by itself. This is why the sealing member 2 in this embodiment has this unique structure.

Next, the sealing member 2 will be described in detail regarding the various structural features for performing the abovementioned functions.

[Coupling (Engaging) Portion]

Next, the referring to FIGS. 9-11, the structure of the coupling (engaging) portion 2*c* of the sealing member 2 in accordance with the present invention will be described.

The sealing member 2 in accordance with the present invention is provided with the cylindrical coupling portion 2*c*. Thus, not only does the sealing member 2 function as a sealing member, but also, it functions as a driving force receiving member. It is enabled to receive the driving force from the driving force transmitting portion 20 of the toner supplying apparatus 400.

As an end of the cylindrical coupling portion 2*c* of the sealing member 2, a plurality of engaging portions 3*b* as hook portions for permitting hook engagement with the driving portion 20 of the main assembly of the image forming apparatus are provided at an entire circumferential surface of the end of the cylindrical coupling portion. Similarly, a plurality of disengaging portions 4 for disengaging the engagement of the engaging portions 3*b* with the driving portion 20 so that each disengaging portion 4 is paired with an associated engaging portion 3*b*.

The coupling portion 2*c* provided with the engaging portions 3*b* and the disengaging portions 4 is constituted so that the portions 3*b* and 5 are elastically deformable freely in a radial direction by providing them with a plurality of slits. A tapered portion 3*c* of these engaging portions 3 is pressed by the driving portion 20 in an area in which the tapered portion is readily placed in an elastically deformable state.

On the other hand, an engaging hole 20*h* of the driving portion 20 provided to the apparatus main assembly 100 is constituted so as to be engaged with the engaging portions 3*b*. Further, at an inner end portion of the driving portion 20, a tapered surface 20*b* for gradually decreasing an inner diameter of the driving portion is provided so as to ensure a smooth operation of overlapping of the sealing member 2 and the driving portion 20 when the sealing member 2 is inserted into the hollow portion of the driving portion 20.

[Snap-Fitting Portion]

Next, referring to FIGS. 9-11, the snap-fitting portion will be described in more detail.

At the end of the snap-fitting portion of the sealing member 2, a multiplicity of engaging portions 3 are provided at an entire circumferential surface of the end of the snap-fitting portion. Each of the engaging portions 3 projects perpendicularly outward in the radius direction of the sealing member 2 from the entire peripheral surface of the cylindrical coupling portion 2*c*. Each engaging portion 3 has the driving force receiving surface 3*a*, as the driving force receiving portion, by which the sealing member 2 receives the rotational force from the apparatus main assembly 100, and an engaging surface 3*b* functioning as an unsealing force receiving portion for receiving an unsealing force for moving the sealing member 2 away from the toner bottle 1 to unseal the toner outlet (opening).

In other words, each engaging portion 3 performs two different functions: the function performed by the driving force receiving surface 3*a*, that is, the function as a coupler for coupling the sealing member 2 with the driving portion 20 in order to make it possible for the sealing member 2 to receive the rotational driving force from the apparatus main assembly 100; and the function performed by the engaging surface 3*b*, that is, the function as a latching (locking) portion for keeping the sealing member 2 engaged with the driving portion 20 in order to make it possible for the toner outlet 1*a* to be automatically unsealed as the sealing member 2 is slid outward relative to the bottle body 1A.

Further, while the sealing member 2 receives the driving force from the driving portion 20, with the load bearing contact surface 3*b* remaining in contact with the internal surface of the catching hole 20*h*, the distance by which the sealing member 2 was pulled out from the toner bottle 1 is kept constant. Therefore, the amount by which the toner is discharged per unit length of time through the toner outlet 1*a* is kept constant, rendering the toner bottle 1 very accurate in terms of the amount by which toner is discharged per unit length of time. Further, the sealing member 2 reliably remains engaged with the driving portion 20 of the apparatus main assembly 100. Therefore, there is no possibility that the sealing member 2 will become disengaged from the toner bottle while the toner is discharged. In other words, this embodiment assures that the toner is satisfactorily discharged.

With the provision of the above described structural arrangement, the function of automatically unsealing or resealing the toner outlet 1*a* of a toner supply container, and the function of receiving the driving force from the main assembly of an image forming apparatus and transmitting the received driving force to the container body 1A of the toner supply container, can be carried out by a single component, that is, the sealing member 2. Therefore, it is possible to provide a toner supply container which is simple in structure and inexpensive.

Although the engaging portions 3 in this embodiment are integrally formed with the sealing member 2, this embodiment is not intended to limit the scope of the present invention. In other words, the engaging portions 3 as the snap-fitting portion may be integrally formed with the sealing member 2, or the engaging portions and sealing member 2 may be formed independently from each other and are bonded to each other to provide an integral structure.

Figure 12:
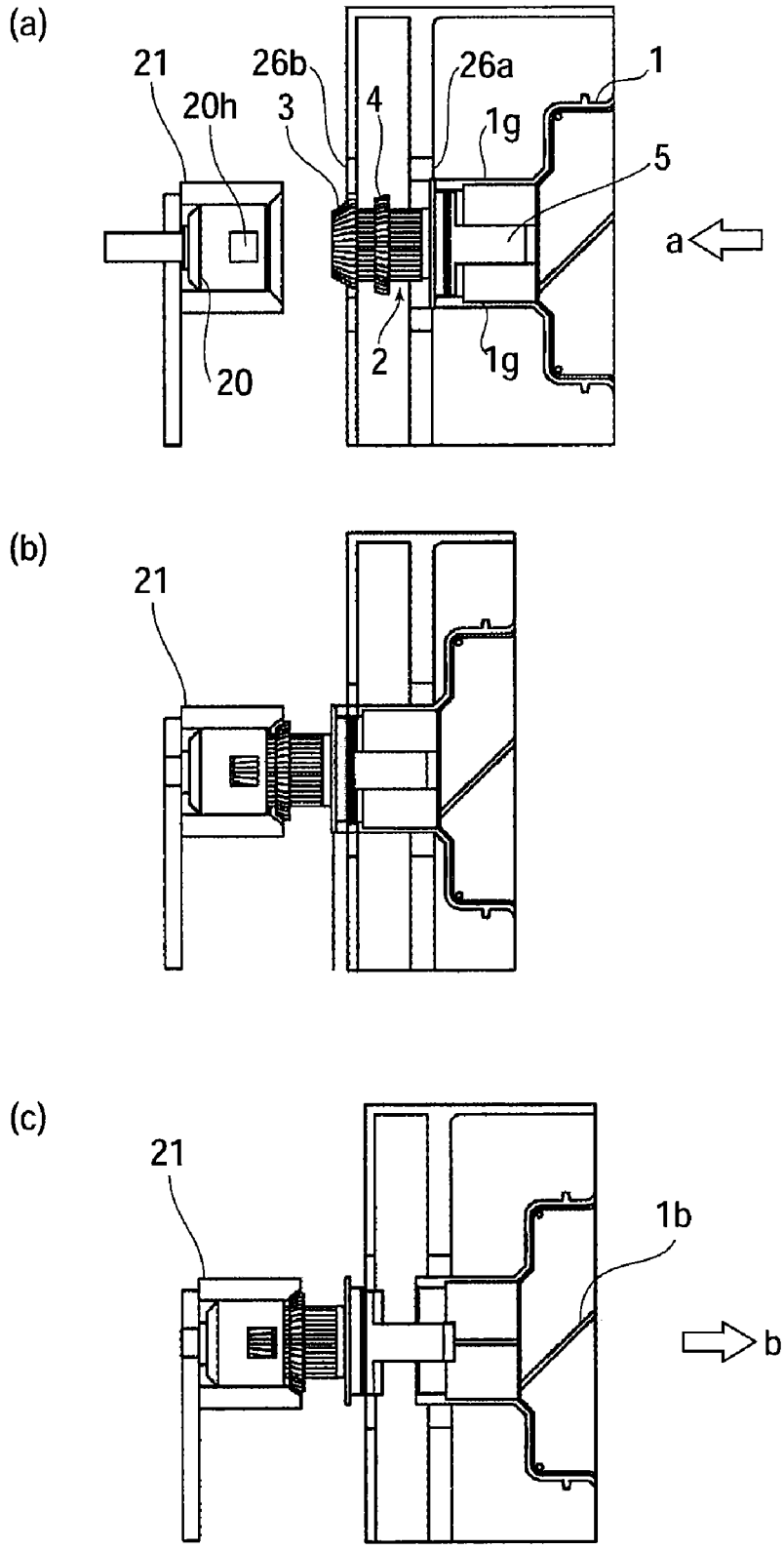
FIGS. 12(*a*), 12(*b*), and 12(*c*) are sectional views of the sealing member portion of the toner supply container and the driving force transmitting portion of the main assembly of the image forming apparatus, showing the process of coupling the sealing member with the driving transmitting portion, immediately prior to the insertion of the toner bottle (toner supply container), during the insertion, and immediately after the unsealing of the toner bottle, respectively.

Also in this embodiment, each of the engaging portions 3 is provided with the tapered surface 3*c* at the end thereof in order to enable the sealing member 2 to smoothly enter the driving portion 20 of the apparatus main assembly 100. This tapered surface 3*c* is a portion for receiving from the internal surface of the cylindrical driving portion 20, an engaging (displacing) force for displacing the engaging portions 3 radially inwardly in the radial direction so as to be engaged with the engaging hole 20*h* by the overlapping operation between the sealing member 2 and the driving portion 20, as shown in FIGS. 11 and 12. As the sealing member 2 enters deeper into the driving portion 20, the engaging surface 3*b* comes closer to the engaging hole 20*h* of the driving portion 20, so that the abutment (contact) of the tapered portion 3*c* with the inner surface of the driving portion 20 is released (removed), i.e., the displacing force is removed. As a result, the portion supporting the engaging portion is elastically restored from the displacement state to the original state, thus completing the engagement (coupling process).

After the completion of the coupling process, by automatically performing such a sliding movement that the sealing member 2 and the bottle body 1A are relatively moved away from each other (in a direction substantially parallel with a rotational axis line of the coupling portion), the toner outlet 1*a* in a closed state is placed in an open state, thus being in a state capable of discharging toner. Incidentally, in this embodiment, in such a state that movement of the sealing member 2 in the sliding direction is regulated by engagement thereof with the apparatus main assembly, automatic unsealing and sealing of the toner outlet 1*a* is performed by moving the bottle body 1A of the toner bottle 1 forward or backward, respectively.

[Disengaging Portion]

Next, the disengaging portion 4 for disengaging the engaging portion 3, which is paired with the engaging portion 3, will be described. The disengaging portion 4 is a projection portion for disengaging the sealing member 2 remaining engaged with the driving portion 20 of the apparatus main assembly 100, when exchanging the toner supply container 1. In other words, the engagement therebetween is released by the unlatching projection 4 in order to remove the toner supply container from the apparatus main assembly 100 and replace it with a new toner supply container.

The disengaging portion 4 and the engaging portion 3 are similarly provided at the entire circumferential surface at the end portion of the sealing member 2. By the sliding operation of the hollow cylindrical disengaging member 21 provided in the main assembly of the image forming apparatus, the disengaging portion 4 is pressed inwardly in a radial direction to displace inwardly, thus disengaging the engagement state. In this case, by sliding the sealing member 2 in a direction apart from the driving portion (in a direction opposite to the above described overlapping direction), the coupling between the sealing member and the driving portion is released. In other words, the disengaging portion 4 has a function of displacing the engaging portion 3 inwardly in the radial direction so as to permit a relative motion between the sealing member and the driving portion so that they are moved apart from each other.

The processes of coupling and uncoupling (engagement and disengagement) of the sealing member 2 will be described later in more detail with reference to FIGS. 12 and 13.

At this time, another function of the sealing member 2, that is, the transmission of the driving force from the main assembly of the image forming apparatus to the bottle body 1A of the toner bottle 1, will be described in detail.

Referring to FIGS. 9 and 10, the sealing member 2 is provided with a pair of the driving force transmitting portions 5 for transmitting the rotational driving force from the image forming apparatus main assembly to the container body 1A. The driving force transmitting portions 5 constitute the opposite end of the sealing member 2 from the coupling portion 2*c*. The driving force transmitting portions 5 oppose each other across the sealing member 2, in terms of the direction perpendicular to the axial line of the sealing member 2. Each driving force transmitting portion 5 projects in such a direction that as the sealing member 2 is inserted, it projects into the toner outlet 1*a*. Although the sealing member 2 in this embodiment is provided with a pair of driving force transmitting portions 5 which oppose each other across the sealing member 2, this embodiment is not intended to limit the number, shape, and location of the driving force transmitting portions 5. In other words, the number, shape, location of the driving force transmitting portions 5 are optional. For example, the number of the driving force transmitting portions 5 may be three, or only one.

One of the lateral surfaces of the driving force transmitting portion 5 constitutes a driving surface 5*a* for transmitting the driving force in the rotational direction. This driving surface comes into contact with the driving force receiving portion 1*b*, which will be described later, to transmit the driving force.

<Engagement of Sealing Member with Driving Portion>

Next, referring to FIG. 12, the process of the engagement between the driving portion 20 with the sealing member 2 will be described. FIG. 12(*a*) shows the states of the developer supply container 1 and the apparatus main assembly 100, in which the former is being inserted by a user into the latter in the direction indicated by an arrow a to be set in the latter, and in which the former is yet to be engaged with the driving portion 20 of the latter.

When the developer supply container is further inserted from the position, as shown in FIG. 12(*b*), the tapered surface 3*c* of the engaging portion 3 provided to the sealing member 2 comes into contact with the driving portion 20. As a result, the engaging portion 3 is elastically deformed while being gradually bent inwardly to be inserted into the driving portion 20.

Figure 14:
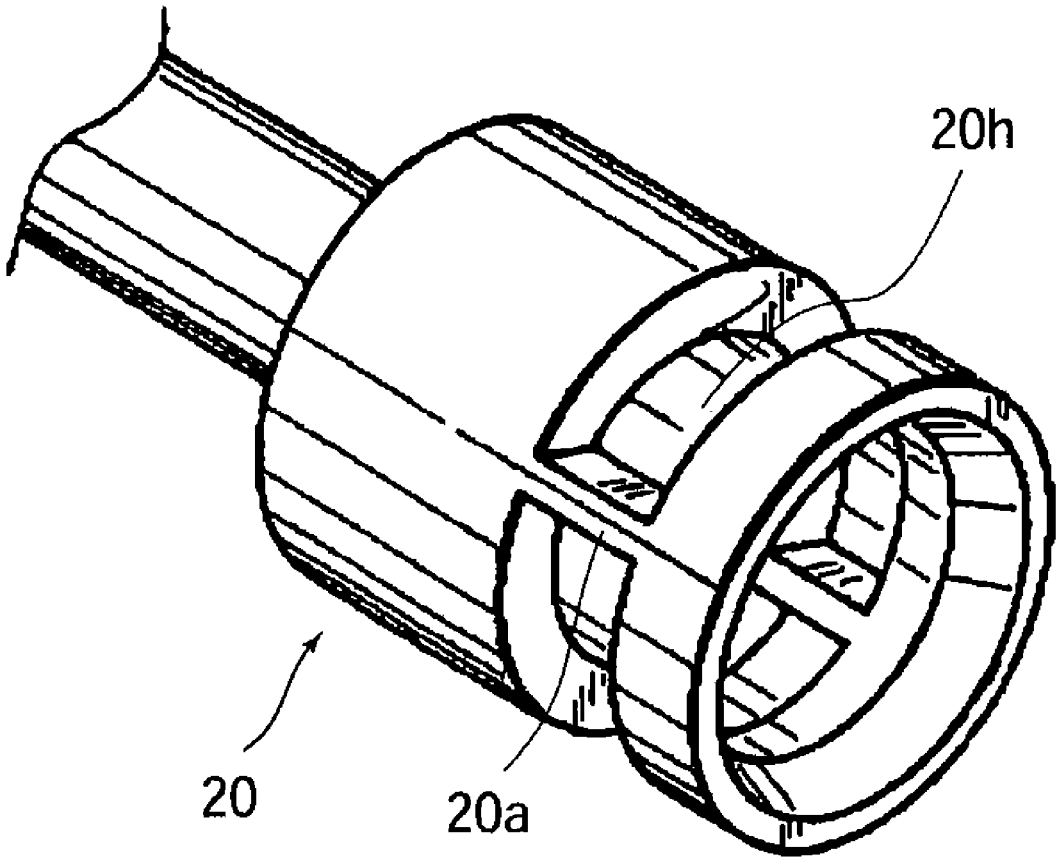
FIG. 14 is a perspective view showing an engaging rib of the driving force transmitting portion.

When the developer supply containers is still further inserted into the driving portion 20 as shown in FIG. 12(*c*), the bending of the engaging portion 3 passed through a straight portion of the driving portion 20 is released in an engaging hole 20*h* as a space in which there is no engaging rib 20 (FIG. 14) and the engaging portion 3 is placed in an engagement state with the driving portion 20. In the engagement state, the engaging portion 3 is firmly engaged with the driving portion 20 and a position of the sealing member 2 in a thrust direction (axial direction) is in such a state that the sealing member 2 is substantially fixed with the apparatus main assembly.

Further, in this case, the engaging portion is provided at the entire circumferential surface of the end portion of the sealing member, so that it is always possible for a user to engage the engaging portion with the driving portion even when the user inserts the developer supply container into the apparatus main assembly in any direction without concern for the rotation direction of the developer supply container.

FIG. 12(*c*) shows a state of the engaging portion 3 engaged with the driving portion 20. As shown in this figure, the entire circumferential surface at the end portion of the sealing member constitutes the engaging portion, so that it is possible to retain a considerably intimate engagement state. Even in the case of a large volumetric developer supply container, it is possible to effect the engagement with reliability and transmit a driving force. As a result, reliability of mounting and demounting of the developer supply container is increased.

More specifically, as the overlapping operation between the driving portion and the engaging portion is performed, an engaging relationship therebetween in the rotation direction is established. In other words, with the overlapping operation between the driving portion and the engaging portion, each of the engaging ribs 20*a* of the driving portion 20 is in such a state that they are substantially sandwiched between engaging portions located upstream and downstream in the rotation direction. Alternatively, with the overlapping operation between the driving portion and engaging portion, each of the engaging holes 20*h* of the driving portions 20 is in such a state that it is filled with the large number of engaging portions with substantially no gap in the rotation direction.

As a result, the sealing member is also started to be rotated simultaneously with the time when the rotation of the driving portion is started, so that it is possible to alleviate the shock due to impingement of the conventional driving portion and sealing member.

Further, engaging portions other than those kept bent by the engaging ribs 20*a* of the driving portion 20 can perform their function, so that it is also possible to maintain a high engagement force.

Further, as described above, only by inserting the developer supply container, it is possible to instantly retain a state capable of transmitting the driving force, i.e., a backlash-free state, so that it is possible to increase a width of the engaging ribs of the driving portion on the image forming apparatus main assembly side. As a result, the strength and the durability of the driving portion can be considerably improved.

Thus, even if the developer supply container 1 is moved backward in the direction indicated by an arrow b in FIG. 12(*c*), the sealing member 2 does not moved backward with the container body 1A of the developer supply container 1; it remains attached to the driving portion 20. In other words, only the container body 1A of the developer supply container 1 is moved backward. Therefore, the sealing member 2 is partially separated from the container body 1A, unsealing thereby the toner outlet 1*a*. Incidentally, regarding the backward movement of the developer supply container 1, the toner supplying apparatus 400 of the main assembly 100 may be structured so that the toner supply container 1 is slid by the opening or closing movement of the toner container exchange front cover 15.

As for the sliding of the sealing member 2 relative to the driving portion 20, the container body 1A of the toner supply container 1 may be slid while the sealing member 2 is kept immobilized, or the sealing member 2 may be slid while the driving portion 20 is kept immobilized. Further, both the sealing member 2 and driving portion 20 may be slid. The process to be carried out to remove the empty developer supply container 1 in the apparatus main assembly 100 in order to exchange it with a new toner supply container after the depletion of the toner in the toner supply container 1 in the apparatus main assembly 100 is the reverse of the above described process to be carried out to mount (coupling and unsealing) the bottle.

More specifically, as an operator opens the above described toner container exchange front cover 15, the following steps are first carried out by the force generated by the movement of the front cover 15: First, the container body 1A of the toner supply container 1 is moved inward of the apparatus main assembly 100, with the sealing member 2 remaining engaged with the apparatus main assembly 100. As a result, the toner outlet 1*a* is automatically resealed by the sealing member 2. Then, the disengaging portions 4 are pressed toward the axial line of the sealing member by the releasing member 21, which will be described later, causing thereby the engaging portions 3 to come out of the catching holes 20*h*. Then, the toner supply container 1 is withdrawn with the sealing member 2, with the engaging portions 3 kept out of the catching holes 20*h*. As a result, the sealing member 2 is disengaged from the apparatus main assembly 100, ending thereby the process of readying the toner supply container 1 for removal.

[Method for Disengagement]

After the completion of the operation for supplying the apparatus main assembly 100 with toner, that is, as the developer supply container 1 becomes empty, the used developer supply container 1 must be removed to be replaced with a new toner supply container. Thus, the engagement between the sealing member 2 and driving portion 20 must be released. Next, the disengaging of the engaging portions 3 from the driving portion 20 of the apparatus main assembly 100 will be described with reference to FIG. 13.

Figure 13:
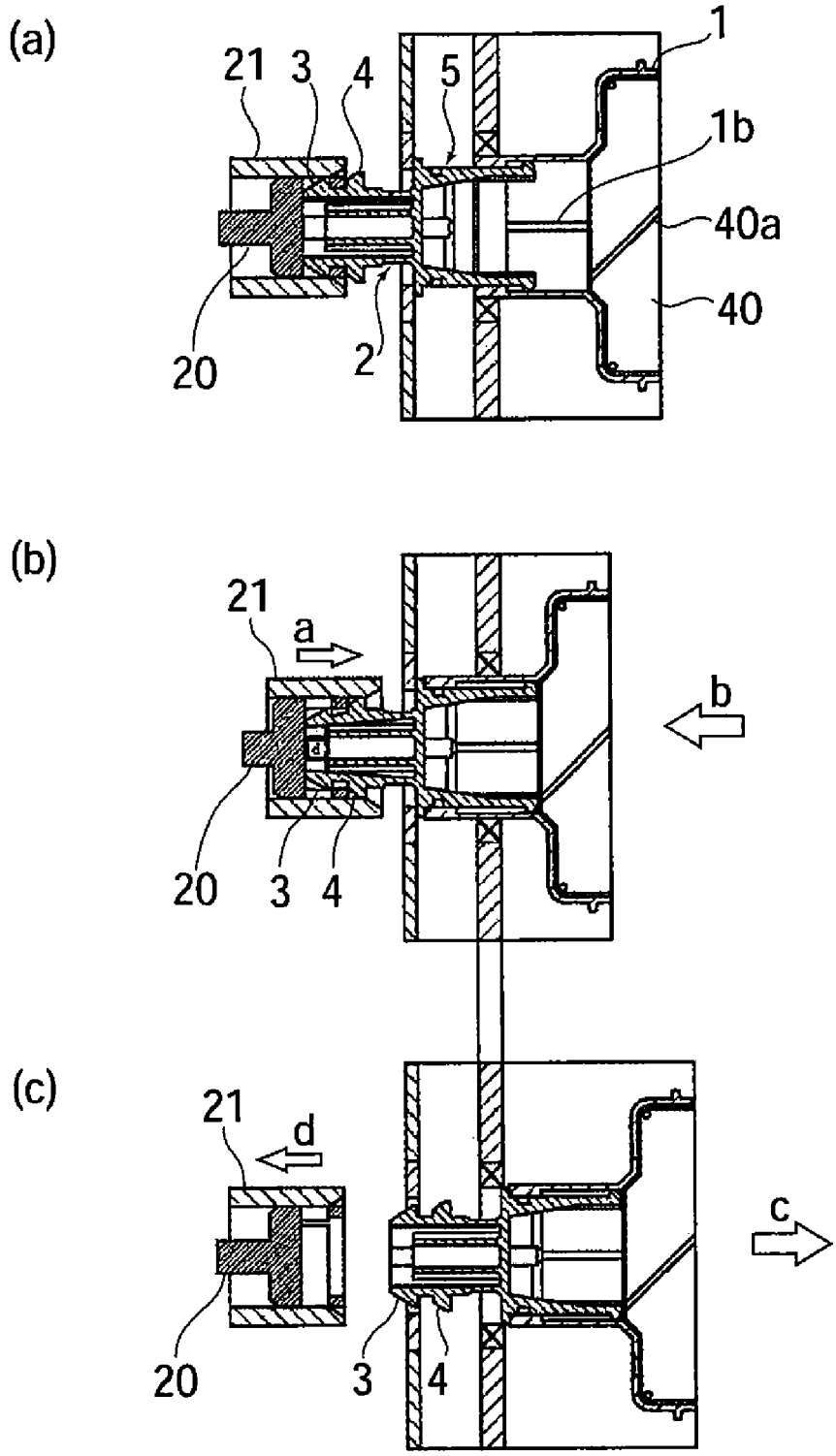
FIGS. 13(*a*), 13(*b*), and 13(*c*) are sectional views of the sealing member portion of the toner supply container and the driving force transmitting portion of the main assembly of the image forming apparatus, showing the process of uncoupling the sealing member from the driving force transmitting portion, immediately prior to the uncoupling, during the uncoupling, and at the completion of the uncoupling, respectively.

Referring to FIG. 13, the apparatus main assembly 100 is provided with the latching projection releasing member 21 (which hereinafter will be referred to as releasing member 21). More specifically, there is the releasing member 21 in the driving portion 20. The releasing member 21 is movable in the direction parallel with the axial line of the developer supply container 1. FIG. 13(*a*) shows the states of the driving portion 20 and toner supply container 1 immediately after the completion of the toner supplying operation, in which the toner outlet 1*a* of the developer supply container 1 is open. As the container exchange front cover 15 is opened when the toner supply container 1 and driving portion 20 are in the states shown in FIG. 13(*a*), the container body 1A is slid in the direction indicated by an arrow mark b by the force generated by the movement of the cover 15, resealing thereby the outlet 1*a*. Then, the releasing member 21 is slid in the direction indicated by an arrow a. As the releasing member 21 advances in the arrow a direction, the disengaging portions 4 located on the cylindrical coupling portion 2*c* of the sealing member 2 are displaced toward the axial line of the sealing member 2, causing the portion of coupling portion 2*b*, from which disengaging portions 4 project, to elastically deform toward axial line of sealing member 2, as shown in FIG. 13(*b*). As a result, the engaging portions 3 projecting from the same portions of the coupling portion 2*c* as do the disengaging portions 4 are also displaced toward the axial line of the sealing member 2, being thereby disengaged from the driving portion 20.

Thereafter, the releasing member 21 is further moved in the arrow a direction by the movement of the front cover 15, and also, the developer supply container 1 is slid in the arrow c direction by the movement of the front cover 15, as shown in FIG. 13(*c*). As a result, the releasing member 21 presses the sealing member 2 into the outlet 1*a*, completely resealing the toner outlet 1*a* of the developer supply container 1. Then, as the releasing member 21 is advanced further in the arrow a direction, the entirety of the toner supply container 1 is slid to the location from which it can be easily removed from the apparatus main assembly 100 by a user.

Regarding the mechanism for driving the releasing member 21, the apparatus main assembly 100 may be structured so that the releasing member 21 is moved by the movement of the container exchange front cover 15, more specifically, so that as the container exchange front cover 15 is opened, the releasing member 21 is moved in the arrow a direction by the movement of the front cover 15, causing thereby the sealing member 2 of the developer supply container 1 to be partially separated from the driving portion 20, and as the front cover 15 is closed, the releasing member 21 is moved in the direction indicated by an arrow mark d by the movement of the front cover 15. Instead, the apparatus main assembly 100 may be provided with a motor or the like dedicated to the releasing member 21 so that the releasing member 21 is moved independently from the movement of the front cover 15. Further, the apparatus main assembly 100 may be provided with a manual lever, the movement of which disengages the sealing member 2 from the driving portion 20. In other words, the method for moving the releasing member 21 is optional.

As described above, this embodiment assures that the toner bottle 1 can be properly snap fitted with the main assembly of an image forming apparatus simply by inserting the toner bottle 1 into the main assembly, and also, that the toner bottle 1 can be easily disengaged from the main assembly simply by pressing the toner supply container disengaging portion 4. Therefore, this embodiment makes it possible to provide a combination of a toner bottle and a toner supplying apparatus, which is very simple in structure, and yet, is superior in operability in terms of toner replenishment.

Further, according to this embodiment, the sealing member 2 for sealing or unsealing the toner outlet 1*a* of the toner supply container 1 is enabled to transmit the driving force for rotationally driving the container body 1A of the toner supply container 1, eliminating the need for providing the apparatus main assembly 100 with both the mechanism for moving the sealing member 1, and the mechanism for rotationally driving the container body 1A, which is independent from the sealing member moving mechanism. In other words, the two functions can be performed by a single component, making it possible to provide a toner replenishment system which is very compact and inexpensive.

Moreover, this embodiment makes it possible to realize a driving force transmitting system which is highly reliable while being very simple in operation, simple in structure, and inexpensive.

Further, not only the engaging portions 3, but also, the disengaging portions 4 are disposed on the entire circumferential surface of the cylindrical coupling portion 2*c*, making it easier to remove the sealing member 2 from the mold therefor, when manufacturing the sealing member 2 of resin by injection molding. Thus, the sealing member 2 in accordance with the present invention is preferable to sealing members in accordance with the prior art, in terms of manufacturing productivity.

Further, it is not necessary to effect a time-consuming operation of a phase alignment of the developer supply container during mounting of the developer supply container in the image forming apparatus. Further, as described above, the engaging portion other than those kept bent by the engaging ribs of the driving portion 20 are released at the position of engaging holes of the driving portion to be engaged thereat. As a result, it is possible to retain a very high engaging force.

Further, when necessary to keep the cost of the sealing member as low as possible, the sealing member may be formed of a single material. For example, the sealing member molded of a type of polyethylene resin, or the like, alone, which is relatively high in elasticity, is definitely satisfactory from the standpoint of practicality.

As for the preferable resinous materials for the sealing member in the present invention, there are ABS resin, polystyrene resin, polyethylene resin, polypropylene resin, straight chain polyamide resin (for example, Nylon (commercial name)), polyester resin, and the like. According to this embodiment, a proper combination can be chosen from among the abovementioned materials, and can be processed as necessary to give the sealing member a desired amount of flexural elastic modulus.

As described above, in this embodiment, the snap-fitting portion, or a portion of the sealing member, which supports the engaging portion 3 and disengaging portion 4, is made elastically deformable. Therefore, the elastic deformation of the portion supporting the engaging portion 3 and disengaging portion 4, and its recovery from the deformation, can be utilized to engage the engaging portion 3 with the driving portion 20 or disengage it therefrom, making it possible to simplify the sealing member in structure. Further, the abovementioned materials have a proper range of elasticity for making it possible for the driving portion 20 and engaging portion 3 to easily engage with each other, or disengage from each other. In addition, these materials are strong enough for the portion supporting the engaging portion 3 and disengaging portion 4 to be durable.

According to the constitutions of the above described embodiments, it is possible to prevent an occurrence of such a conventional impingement shock that it is caused by impingement of the ribs of the cylindrical member of the apparatus main assembly with the projection portion of the coupling member of the developer supply container at the time of starting the rotation of the cylindrical member of the apparatus main assembly.

Incidentally, the present invention is not limited to the above described constitutions of the coupling member but may also have the following constitution.

It is such a constitution that a link scheme is adopted instead of the above described snap-fitting portion utilizing an elastic deformation force of resin. More specifically, it is such a constitution that, similarly as in the above described embodiments, a multiplicity of arm portions as a movable member are provided so as to be movable in a radial direction through a hinge portion at a basal portion of the main body of the sealing member, and each of these arm portions is urged radially outwardly in a radial direction by an urging member. Each of the arm portions is provided with a disengaging portion having the same function as in the above described embodiments.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 366015/2004 filed Dec. 17, 2004, which is hereby incorporated by reference.

What is claimed is:

1. A developer supply container detachably mountable to an image forming apparatus including a hollow cylindrical member having at least one hole and at least one rib formed between circumferential ends of one hole or between adjacent ones of a plurality of holes, comprising:

a container body for containing toner;

a coupling member including a plurality of hooks for hooking engagement with the at least one hole of the cylindrical member by relative motion between the cylindrical member and said coupling member in a direction of overlapping therebetween, and at least one of said hooks receiving a rotational force by abutment of the at least one rib to discharge the developer out of said container body, wherein said hooks are provided at an entire circumferential surface of said coupling member so as to establish an engageable relationship between the cylindrical member and said coupling member in a rotation direction of said coupling member by the relative motion.

2. A developer supply container according to claim 1, wherein each of the at least one hole is filled with said hooks with substantially no gap in the rotation direction of said coupling member by the relative motion.

3. A developer supply container according to claim 1, wherein said coupling member includes a plurality of displacing force receiving portions for receiving, from the image forming apparatus, a displacing force for displacing said hooks substantially radially inwardly to permit a relative motion between the cylindrical member and said coupling member in a direction opposite to the direction of overlapping.

4. A developer supply container according to claim 3, wherein said displacing force receiving portions receive the displacing force from a hollow member which is provided in the image forming apparatus outside the cylindrical member, and wherein said displacing force receiving portions are disposed at a position closer to said container body than said hooks with respect to the direction of overlapping.

5. A toner supply container according to claim 4, wherein a radially outermost part of said displacing force receiving portions is more remote from a rotation axis of said coupling member than a radially outermost part of said hooks.

6. A developer supply container according to claim 1, wherein at least one of said hooks receive an opening force substantially in a direction parallel with a rotation axis of said coupling member to open said container to permit discharge of the toner out of said container body.

7. A developer supply container according to claim 1, further comprising a feeding portion for feeding the developer in said container body with rotation of said container body by the rotational force.

8. A developer supply container according to claim 1, wherein said coupling member is made of a plastic material, and wherein said hooks are elastically restorable in a direction of the hooking engagement.

9. A developer supply container detachably mountable to an image forming apparatus including a hollow cylindrical member having at least one hole and at least one rib formed between circumferential ends of one hole or between adjacent ones of a plurality of holes, comprising:

a container body for containing toner;

a coupling member including a plurality of hooks for hooking engagement with the at least one hole of the cylindrical member by relative motion between the cylindrical member and said coupling member in a direction of overlapping therebetween, and at least one of said hooks receiving a rotational force by abutment of the at least one rib to discharge the developer out of said container body, wherein said hooks are provided at an entire circumferential surface of said coupling member so that each of the at least one rib is sandwiched between two of said hooks in a rotation direction of said coupling member by the relative motion.

10. A developer supply container according to claim 9, wherein one of said hooks is kept displaced by the rib.

11. A developer supply container according to claim 9, wherein said coupling member includes a plurality of displacing force receiving portions for receiving, from the image forming apparatus, a displacing force for displacing said hooks substantially radially inwardly to permit a relative motion between the cylindrical member and said coupling member in a direction opposite to the direction of overlapping.

12. A developer supply container according to claim 11, wherein said displacing force receiving portions receive the displacing force from a hollow member which is provided in the image forming apparatus outside the cylindrical member, and wherein said displacing force receiving portions are disposed at a position closer to said container body than said hooks with respect to the direction of overlapping.

13. A toner supply container according to claim 12, wherein a radially outermost part of said displacing force receiving portions is more remote from a rotation axis of said coupling member than a radially outermost part of said hooks.

14. A developer supply container according to claim 9, wherein at least one of said hooks receive an opening force substantially in a direction parallel with a rotation axis of said coupling member to open said container to permit discharge of the toner out of said container body.

15. A developer supply container according to claim 9, further comprising a feeding portion for feeding the developer in said container body with rotation of said container body by the rotational force.

16. A developer supply container according to claim 9, wherein said coupling member is made of a plastic material, and wherein said hooks are elastically restorable in a direction of the hooking engagement.

17. A coupling member of a developer supply container which is detachably mountable to an image forming apparatus including a hollow cylindrical member having at least one hole and at least one rib formed between circumferential ends of one hole or between adjacent ones of a plurality of holes, comprising:

a coupling portion including a plurality of hooks for hooking engagement with the at least one hole of the cylindrical member by relative motion between the cylindrical member and said coupling portion in a direction of overlapping therebetween, and at least one of said hooks receiving a rotational force by abutment of the at least one rib to discharge the developer out of said container body, wherein said hooks are provided at an entire circumferential surface of said coupling member so as to establish an engageable relationship between the cylindrical member and said coupling member in a rotation direction of said coupling member by the relative motion.

18. A coupling member of a developer supply container which is detachably mountable to an image forming apparatus including a hollow cylindrical member having at least one hole and at least one rib formed between circumferential ends of one hole or between adjacent ones of a plurality of holes, comprising:

a coupling portion including a plurality of hooks for hooking engagement with the at least one hole of the cylindrical member by relative motion between the cylindrical member and said coupling portion in a direction of overlapping therebetween, and at least one of said hooks receiving a rotational force by abutment of the at least one rib to discharge the developer out of said container body, wherein said hooks are provided at an entire circumferential surface of said coupling member so that each of the at least one rib is sandwiched between two of said hooks in a rotation direction of said coupling member by the relative motion.

* * * * *

UNITED STATES PATENT AND TRADEMARK OFFICE

CERTIFICATE OF CORRECTION

PATENT NO. : 7,391,999 B2
APPLICATION NO. : 11/275164
DATED : June 24, 2008
INVENTOR(S) : Yusuke Yamada It is certified that error appears in the above-identified patent and that said Letters Patent is hereby corrected as shown below:

TITLE PAGE ITEM [57] ABSTRACT
Line 7, "impinges" should read --impinge--.

COLUMN 2
Line 4, "unseals" should read --unseal--.

COLUMN 6
Line 42, "201*f*by" should read --201*f* by--.

COLUMN 7
Line 3, "mounting" should read --mounted--.

COLUMN 9
Line 59, "these" should be deleted.

COLUMN 15
Line 17, "containers" should read --container--.

COLUMN 16
Line 8, "moved" should read --move--.

Signed and Sealed this

Second Day of December, 2008

JON W. DUDAS
*Director of the United States Patent and Trademark Office*